US008795053B2

(12) United States Patent
Brune et al.

(10) Patent No.: US 8,795,053 B2
(45) Date of Patent: Aug. 5, 2014

(54) GAMING SYSTEM AND METHOD PROVIDING ONE OR MORE INDICATIONS ASSOCIATED WITH A PLAYER-SELECTED SYMBOL COMBINATION FOR A PLAY OF A PACHISURO-STYLE SLOT GAME

(71) Applicant: IGT, Reno, NV (US)

(72) Inventors: Christopher T. Brune, Carson City, NV (US); Ross D. Wenker, Reno, NV (US); Meng Yang Oh, Reno, NV (US)

(73) Assignee: IGT, Las Vegas, NV (US)

( * ) Notice: Subject to any disclaimer, the term of this patent is extended or adjusted under 35 U.S.C. 154(b) by 129 days.

(21) Appl. No.: 13/625,572

(22) Filed: Sep. 24, 2012

(65) Prior Publication Data

US 2014/0087820 A1 Mar. 27, 2014

(51) Int. Cl.
*G07F 17/32* (2006.01)

(52) U.S. Cl.
USPC ..... 463/16; 463/20; 463/25; 463/29

(58) Field of Classification Search
IPC ..... G07F 17/32
See application file for complete search history.

(56) References Cited

U.S. PATENT DOCUMENTS

| | | | |
|---|---|---|---|
| 4,236,717 | A | 12/1980 | Wichinsky |
| 4,448,419 | A | 5/1984 | Telnaes |
| 4,582,324 | A | 4/1986 | Koza et al. |
| 4,618,150 | A | 10/1986 | Kimura |
| 4,657,256 | A | 4/1987 | Okada |
| 4,695,053 | A | 9/1987 | Vazquez, Jr. et al. |
| 4,858,932 | A | 8/1989 | Keane |
| 4,871,171 | A | 10/1989 | Rivero |
| 4,889,339 | A | 12/1989 | Okada |
| 5,074,559 | A | 12/1991 | Okada |
| 5,123,649 | A | 6/1992 | Tiberio |
| 5,263,716 | A | 11/1993 | Smyth |
| 5,342,047 | A | 8/1994 | Heidel et al. |
| 5,393,061 | A | 2/1995 | Manship et al. |
| 5,449,173 | A | 9/1995 | Thomas et al. |
| 5,524,888 | A | 6/1996 | Heidel |
| 5,609,524 | A | 3/1997 | Inoue |
| 5,639,089 | A | 6/1997 | Matsumoto et al. |

(Continued)

FOREIGN PATENT DOCUMENTS

| | | |
|---|---|---|
| AU | 2003/244623 | 3/2004 |
| EP | 0 443 738 | 8/1991 |

(Continued)

*Primary Examiner* — Omkar Deodhar
(74) *Attorney, Agent, or Firm* — Neal, Gerber & Eisenberg LLP

(57) ABSTRACT

The present disclosure is directed to a gaming system and method providing one or more indications associated with a player-selected winning symbol combination for a play of a Pachisuro-style slot game. The gaming system includes a plurality of reels, each of which includes a plurality of symbols, and a separate stop input device associated with each reel. While each reel is spinning, the gaming system enables the player to activate the associated stop input device to cause the gaming system to stop that reel from spinning. For a play of the game, the gaming system enables a player to select a desired winning symbol combination. The gaming system spins the reels and, while the reels are spinning, indicates when the player should activate the stop input devices to cause the gaming system to stop the reels such that a probability of the desired winning symbol combination being displayed is maximized.

18 Claims, 41 Drawing Sheets

(56) References Cited

U.S. PATENT DOCUMENTS

| | | | |
|---|---|---|---|
| 5,695,188 | A | 12/1997 | Ishibashi |
| 5,769,716 | A | 6/1998 | Saffari et al. |
| 5,772,509 | A | 6/1998 | Weiss |
| 5,788,573 | A | 8/1998 | Baerlocher et al. |
| 5,823,874 | A | 10/1998 | Adams |
| 5,833,536 | A | 11/1998 | Davids et al. |
| 5,833,537 | A | 11/1998 | Barrie |
| 5,848,932 | A | 12/1998 | Adams |
| 5,863,249 | A | 1/1999 | Inoue |
| 5,873,781 | A | 2/1999 | Keane |
| 5,882,261 | A | 3/1999 | Adams |
| 5,910,046 | A | 6/1999 | Wada et al. |
| 5,911,418 | A | 6/1999 | Adams |
| 5,941,770 | A | 8/1999 | Miers et al. |
| 5,951,397 | A | 9/1999 | Dickinson |
| 5,988,638 | A | 11/1999 | Rodesch et al. |
| 6,015,346 | A | 1/2000 | Bennett |
| 6,019,369 | A | 2/2000 | Nakagawa et al. |
| 6,047,963 | A | 4/2000 | Pierce et al. |
| 6,050,895 | A | 4/2000 | Luciano, Jr. et al. |
| 6,071,192 | A | 6/2000 | Weiss |
| 6,089,976 | A | 7/2000 | Schneider et al. |
| 6,089,978 | A | 7/2000 | Adams |
| 6,102,798 | A | 8/2000 | Bennett |
| 6,110,039 | A | 8/2000 | Oh |
| 6,110,040 | A | 8/2000 | Sanduski et al. |
| 6,110,041 | A | 8/2000 | Walker et al. |
| 6,117,007 | A | 9/2000 | Matsuyama et al. |
| 6,117,008 | A | 9/2000 | Machiguchi |
| 6,139,013 | A | 10/2000 | Pierce et al. |
| 6,142,873 | A | 11/2000 | Weiss et al. |
| 6,142,874 | A | 11/2000 | Kodachi et al. |
| 6,142,875 | A | 11/2000 | Kodachi et al. |
| 6,159,095 | A | 12/2000 | Frohm et al. |
| 6,159,097 | A | 12/2000 | Gura |
| 6,165,070 | A | 12/2000 | Nolte et al. |
| 6,174,233 | B1 | 1/2001 | Sunaga et al. |
| 6,174,235 | B1 | 1/2001 | Walker et al. |
| 6,210,279 | B1 | 4/2001 | Dickinson |
| 6,220,593 | B1 | 4/2001 | Pierce et al. |
| 6,261,177 | B1 | 7/2001 | Bennett |
| 6,267,669 | B1 | 7/2001 | Luciano, Jr. et al. |
| 6,270,408 | B1 | 8/2001 | Sakamoto et al. |
| 6,315,660 | B1 | 11/2001 | Demar et al. |
| 6,315,664 | B1 | 11/2001 | Baerlocher et al. |
| 6,464,581 | B1 | 10/2002 | Yoseloff et al. |
| 6,506,114 | B1 | 1/2003 | Estes et al. |
| 6,572,473 | B1 | 6/2003 | Baerlocher |
| 6,641,477 | B1 | 11/2003 | Dietz, II |
| 6,666,765 | B2 | 12/2003 | Vancura |
| 6,666,766 | B2 | 12/2003 | Baerlocher et al. |
| 6,676,512 | B2 | 1/2004 | Fong et al. |
| 6,726,204 | B2 | 4/2004 | Inoue |
| 6,761,632 | B2 | 7/2004 | Bansemer et al. |
| 6,780,103 | B2 | 8/2004 | Bansemer et al. |
| 6,835,133 | B2 | 12/2004 | Baerlocher et al. |
| 6,852,027 | B2 | 2/2005 | Kaminkow et al. |
| 6,855,054 | B2 | 2/2005 | White et al. |
| 6,863,606 | B1 | 3/2005 | Berg et al. |
| 6,893,341 | B2 | 5/2005 | Walker et al. |
| 6,918,830 | B2 | 7/2005 | Baerlocher |
| 6,942,568 | B2 | 9/2005 | Baerlocher |
| 6,942,571 | B1 | 9/2005 | Mcallister et al. |
| 6,984,174 | B2 | 1/2006 | Cannon et al. |
| 7,056,210 | B2 | 6/2006 | Bansemer et al. |
| 7,077,744 | B2 | 7/2006 | Cannon |
| 7,169,044 | B2 | 1/2007 | Baerlocher et al. |
| 7,175,521 | B2 | 2/2007 | Mcclintic |
| 7,175,524 | B2 | 2/2007 | Bansemer et al. |
| 7,217,187 | B2 | 5/2007 | Vancura |
| 7,326,115 | B2 | 2/2008 | Baerlocher |
| 7,473,175 | B2 | 1/2009 | Baerlocher |
| 7,654,899 | B2 | 2/2010 | Durham et al. |
| 7,666,094 | B2 | 2/2010 | Baerlocher et al. |
| 7,674,178 | B2 | 3/2010 | Baerlocher et al. |
| 7,674,179 | B2 | 3/2010 | Baerlocher et al. |
| 7,677,971 | B2 | 3/2010 | Baerlocher et al. |
| 7,677,972 | B2 | 3/2010 | Baerlocher et al. |
| 7,682,248 | B2 | 3/2010 | Baerlocher et al. |
| 7,993,191 | B2 | 8/2011 | Evans et al. |
| 8,096,878 | B2 | 1/2012 | Durham et al. |
| 8,128,477 | B2 | 3/2012 | Durham et al. |
| 8,210,942 | B2 | 7/2012 | Shimabukuro et al. |
| 2003/0125107 | A1 | 7/2003 | Cannon et al. |
| 2003/0207707 | A1 | 11/2003 | Slomiany et al. |
| 2004/0023713 | A1 | 2/2004 | Wolf et al. |
| 2004/0048650 | A1 | 3/2004 | Mierau et al. |
| 2004/0219965 | A1 | 11/2004 | Okada |
| 2005/0009595 | A1 | 1/2005 | Boyd et al. |
| 2005/0029977 | A1 | 2/2005 | Nireki et al. |
| 2005/0101378 | A1 | 5/2005 | Kaminkow et al. |
| 2006/0046830 | A1 | 3/2006 | Webb et al. |
| 2006/0205474 | A1 | 9/2006 | Bansemer et al. |
| 2007/0129133 | A1 | 6/2007 | Bansemer et al. |
| 2007/0155464 | A1 | 7/2007 | Baerlocher et al. |
| 2008/0119283 | A1 | 5/2008 | Baerlocher |
| 2008/0311980 | A1 | 12/2008 | Cannon |
| 2009/0258696 | A1 | 10/2009 | Chim |
| 2010/0190546 | A1 | 7/2010 | Baerlocher et al. |
| 2010/0234089 | A1* | 9/2010 | Saffari et al. ..... 463/20 |
| 2010/0234091 | A1* | 9/2010 | Baerlocher et al. ..... 463/20 |
| 2011/0183746 | A1 | 7/2011 | Englman et al. |
| 2011/0212766 | A1 | 9/2011 | Bowers et al. |

FOREIGN PATENT DOCUMENTS

| | | |
|---|---|---|
| EP | 0 688 002 | 12/1995 |
| EP | 1 184 822 | 3/2002 |
| GB | 1 476 848 | 6/1977 |
| GB | 2 100 905 | 6/1983 |
| GB | 2 147 442 | 9/1985 |
| GB | 2 165 385 | 9/1986 |
| GB | 2 180 087 | 3/1987 |
| GB | 2 183 883 | 6/1987 |
| GB | 2 226 436 | 6/1990 |
| GB | 2 335 524 | 9/1999 |
| GB | 2 393 555 | 3/2004 |
| JP | H11-9765 | 1/1999 |
| WO | WO 88/08179 | 10/1988 |
| WO | WO 2006/028860 | 3/2006 |

* cited by examiner

FIG. 2

1154a 1154b 1154c 100

| Stop Position | First Reel | Second Reel | Third Reel |
|---|---|---|---|
| 0 | Orange | 2 Bar | Cherry |
| 1 | Bonus | Free Shot | Blue 7 |
| 2 | 3 Bar | Bonus | Red 7 |
| 3 | Jackpot | 1 Bar | Bell |
| 4 | Bell | Bell | Freeshot |
| 5 | Free Shot | Jackpot | Jackpot |
| 6 | Orange | Free Shot | 1 Bar |
| 7 | Blue 7 | 3 Bar | Orange |
| 8 | 1 Bar | Blue 7 | Free Shot |
| 9 | Red 7 | Cherry | 2 Bar |
| 10 | 2 Bar | Orange | Bonus |
| 11 | Free Shot | Blue 7 | 3 Bar |
| 12 | Bell | Jackpot | Blue 7 |
| 13 | Blue 7 | 3 Bar | Bonus |
| 14 | Cherry | Bell | Free Shot |
| 15 | 2 Bar | Cherry | Bell |
| 16 | Blue 7 | Red 7 | 2 Bar |
| 17 | Red 7 | Orange | Bonus |
| 18 | Free Shot | Bonus | Orange |
| 19 | Orange | Free Shot | Free Shot |
| 20 | Jackpot | 3 Bar | Red 7 |
| 21 | 1 Bar | 1 Bar | 1 Bar |

FIG. 4A

Virtual Map For First Reel,
Stop Position 0

110a

| Stop Position | Symbol | Weight |
|---|---|---|
| 17 | Red 7 | 46 |
| 18 | Free Shot | 68 |
| 19 | Orange | 59 |
| 20 | Jackpot | 19 |
| 21 | 1 Bar | 64 |

FIG. 4B

Virtual Map For First Reel,
Stop Position 1

110b

| Stop Position | Symbol | Weight |
|---|---|---|
| 18 | Free Shot | 85 |
| 19 | Orange | 26 |
| 20 | Jackpot | 28 |
| 21 | 1 Bar | 19 |
| 0 | Orange | 98 |

FIG. 4C

Virtual Map For First Reel,
Stop Position 2

110c

| Stop Position | Symbol | Weight |
|---|---|---|
| 19 | Orange | 24 |
| 20 | Jackpot | 46 |
| 21 | 1 Bar | 13 |
| 0 | Orange | 75 |
| 1 | Bonus | 98 |

FIG. 4D

Virtual Map For First Reel,
Stop Position 3

110d

| Stop Position | Symbol | Weight |
|---|---|---|
| 20 | Jackpot | 56 |
| 21 | 1 Bar | 18 |
| 0 | Orange | 98 |
| 1 | Bonus | 72 |
| 2 | 3 Bar | 12 |

FIG. 4E

Virtual Map For First Reel,
Stop Position 4

110e

| Stop Position | Symbol | Weight |
|---|---|---|
| 21 | 1 Bar | 40 |
| 0 | Orange | 60 |
| 1 | Bonus | 88 |
| 2 | 3 Bar | 40 |
| 3 | Jackpot | 28 |

FIG. 4F

Virtual Map For First Reel,
Stop Position 5

110f

| Stop Position | Symbol | Weight |
|---|---|---|
| 0 | Orange | 105 |
| 1 | Bonus | 80 |
| 2 | 3 Bar | 15 |
| 3 | Jackpot | 48 |
| 4 | Bell | 10 |

FIG. 4G

Virtual Map For First Reel,
Stop Position 6

110g

| Stop Position | Symbol | Weight |
|---|---|---|
| 1 | Bonus | 102 |
| 2 | 3 Bar | 16 |
| 3 | Jackpot | 59 |
| 4 | Bell | 10 |
| 5 | Free Shot | 69 |

FIG. 4H

Virtual Map For First Reel,
Stop Position 7

110h

| Stop Position | Symbol | Weight |
|---|---|---|
| 2 | 3 Bar | 20 |
| 3 | Jackpot | 64 |
| 4 | Bell | 11 |
| 5 | Free Shot | 54 |
| 6 | Orange | 107 |

FIG. 4I

Virtual Map For First Reel,
Stop Position 8

110i

| Stop Position | Symbol | Weight |
|---|---|---|
| 3 | Jackpot | 47 |
| 4 | Bell | 9 |
| 5 | Free Shot | 25 |
| 6 | Orange | 80 |
| 7 | Blue 7 | 95 |

FIG. 4J

Virtual Map For First Reel,
Stop Position 9

110j

| Stop Position | Symbol | Weight |
|---|---|---|
| 4 | Bell | 7 |
| 5 | Free Shot | 42 |
| 6 | Orange | 64 |
| 7 | Blue 7 | 87 |
| 8 | 1 Bar | 56 |

FIG. 4K

Virtual Map For First Reel,
Stop Position 10

110k

| Stop Position | Symbol | Weight |
|---|---|---|
| 5 | Free Shot | 46 |
| 6 | Orange | 33 |
| 7 | Blue 7 | 72 |
| 8 | 1 Bar | 24 |
| 9 | Red 7 | 81 |

FIG. 4L

Virtual Map For First Reel,
Stop Position 11

110l

| Stop Position | Symbol | Weight |
|---|---|---|
| 6 | Orange | 46 |
| 7 | Blue 7 | 74 |
| 8 | 1 Bar | 19 |
| 9 | Red 7 | 73 |
| 10 | 2 Bar | 44 |

FIG. 4M

Virtual Map For First Reel,
Stop Position 12

110m

| Stop Position | Symbol | Weight |
|---|---|---|
| 7 | Blue 7 | 65 |
| 8 | 1 Bar | 16 |
| 9 | Red 7 | 51 |
| 10 | 2 Bar | 19 |
| 11 | Free Shot | 105 |

FIG. 4N

Virtual Map For First Reel,
Stop Position 13

110n

| Stop Position | Symbol | Weight |
|---|---|---|
| 8 | 1 Bar | 19 |
| 9 | Red 7 | 61 |
| 10 | 2 Bar | 20 |
| 11 | Free Shot | 84 |
| 12 | Bell | 72 |

FIG. 4O

Virtual Map For First Reel,
Stop Position 14

110o

| Stop Position | Symbol | Weight |
|---|---|---|
| 9 | Red 7 | 65 |
| 10 | 2 Bar | 29 |
| 11 | Free Shot | 94 |
| 12 | Bell | 44 |
| 13 | Blue 7 | 24 |

FIG. 4P

Virtual Map For First Reel,
Stop Position 15

110p

| Stop Position | Symbol | Weight |
|---|---|---|
| 10 | 2 Bar | 47 |
| 11 | Free Shot | 91 |
| 12 | Bell | 82 |
| 13 | Blue 7 | 6 |
| 14 | Cherry | 30 |

FIG. 4Q

Virtual Map For First Reel,
Stop Position 16

110q

| Stop Position | Symbol | Weight |
|---|---|---|
| 11 | Free Shot | 100 |
| 12 | Bell | 89 |
| 13 | Blue 7 | 8 |
| 14 | Cherry | 48 |
| 15 | 2 Bar | 11 |

FIG. 4R

Virtual Map For First Reel,
Stop Position 17

110r

| Stop Position | Symbol | Weight |
|---|---|---|
| 12 | Bell | 102 |
| 13 | Blue 7 | 7 |
| 14 | Cherry | 42 |
| 15 | 2 Bar | 11 |
| 16 | Blue 7 | 94 |

FIG. 4S

Virtual Map For First Reel,
Stop Position 18

110s

| Stop Position | Symbol | Weight |
|---|---|---|
| 13 | Blue 7 | 8 |
| 14 | Cherry | 48 |
| 15 | 2 Bar | 9 |
| 16 | Blue 7 | 98 |
| 17 | Red 7 | 93 |

FIG. 4T

Virtual Map For First Reel,
Stop Position 19

110t

| Stop Position | Symbol | Weight |
|---|---|---|
| 14 | Cherry | 33 |
| 15 | 2 Bar | 10 |
| 16 | Blue 7 | 64 |
| 17 | Red 7 | 61 |
| 18 | Free Shot | 88 |

FIG. 4U

Virtual Map For First Reel,
Stop Position 20

110u

| Stop Position | Symbol | Weight |
|---|---|---|
| 15 | 2 Bar | 11 |
| 16 | Blue 7 | 71 |
| 17 | Red 7 | 78 |
| 18 | Free Shot | 80 |
| 19 | Orange | 16 |

FIG. 4V

Virtual Map For First Reel,
Stop Position 21

110v

| Stop Position | Symbol | Weight |
|---|---|---|
| 16 | Blue 7 | 70 |
| 17 | Red 7 | 78 |
| 18 | Free Shot | 80 |
| 19 | Orange | 10 |
| 20 | Jackpot | 18 |

FIG. 5A

Virtual Map For Second Reel, Stop Position 0

120a

| Stop Position | Symbol | Weight |
|---|---|---|
| 17 | Orange | 38 |
| 18 | Bonus | 89 |
| 19 | Free Shot | 61 |
| 20 | 3 Bar | 25 |
| 21 | 1 Bar | 43 |

FIG. 5B

Virtual Map For Second Reel, Stop Position 1

120b

| Stop Position | Symbol | Weight |
|---|---|---|
| 18 | Bonus | 52 |
| 19 | Free Shot | 42 |
| 20 | 3 Bar | 51 |
| 21 | 1 Bar | 52 |
| 0 | 2 Bar | 59 |

FIG. 5C

Virtual Map For Second Reel, Stop Position 2

120c

| Stop Position | Symbol | Weight |
|---|---|---|
| 19 | Free Shot | 56 |
| 20 | 3 Bar | 61 |
| 21 | 1 Bar | 38 |
| 0 | 2 Bar | 35 |
| 1 | Free Shot | 66 |

FIG. 5D

Virtual Map For Second Reel, Stop Position 3

120d

| Stop Position | Symbol | Weight |
|---|---|---|
| 20 | 3 Bar | 34 |
| 21 | 1 Bar | 77 |
| 0 | 2 Bar | 42 |
| 1 | Free Shot | 21 |
| 2 | Bonus | 72 |

FIG. 5E

Virtual Map For Second Reel, Stop Position 4

120e

| Stop Position | Symbol | Weight |
|---|---|---|
| 21 | 1 Bar | 63 |
| 0 | 2 Bar | 53 |
| 1 | Free Shot | 40 |
| 2 | Bonus | 39 |
| 3 | 1 Bar | 61 |

FIG. 5F

Virtual Map For Second Reel, Stop Position 5

120f

| Stop Position | Symbol | Weight |
|---|---|---|
| 0 | 2 Bar | 52 |
| 1 | Free Shot | 48 |
| 2 | Bonus | 39 |
| 3 | 1 Bar | 69 |
| 4 | Bell | 48 |

FIG. 5G

Virtual Map For Second Reel, Stop Position 6

120g

| Stop Position | Symbol | Weight |
|---|---|---|
| 1 | Free Shot | 25 |
| 2 | Bonus | 114 |
| 3 | 1 Bar | 40 |
| 4 | Bell | 11 |
| 5 | Jackpot | 66 |

FIG. 5H

Virtual Map For Second Reel, Stop Position 7

120h

| Stop Position | Symbol | Weight |
|---|---|---|
| 2 | Bonus | 35 |
| 3 | 1 Bar | 99 |
| 4 | Bell | 45 |
| 5 | Jackpot | 11 |
| 6 | Free Shot | 66 |

FIG. 5I

Virtual Map For Second Reel, Stop Position 8

120i

| Stop Position | Symbol | Weight |
|---|---|---|
| 3 | 1 Bar | 50 |
| 4 | Bell | 57 |
| 5 | Jackpot | 10 |
| 6 | Free Shot | 60 |
| 7 | 3 Bar | 79 |

FIG. 5J

Virtual Map For Second Reel,
Stop Position 9

120j

| Stop Position | Symbol | Weight |
|---|---|---|
| 4 | Bell | 29 |
| 5 | Jackpot | 6 |
| 6 | Freeshot | 48 |
| 7 | 3 Bar | 101 |
| 8 | Blue 7 | 72 |

FIG. 5K

Virtual Map For Second Reel,
Stop Position 10

120k

| Stop Position | Symbol | Weight |
|---|---|---|
| 5 | Jackpot | 36 |
| 6 | Free Shot | 63 |
| 7 | 3 Bar | 80 |
| 8 | Blue 7 | 66 |
| 9 | Cherry | 11 |

FIG. 5L

Virtual Map For Second Reel,
Stop Position 11

120l

| Stop Position | Symbol | Weight |
|---|---|---|
| 6 | Free Shot | 80 |
| 7 | 3 Bar | 64 |
| 8 | Blue 7 | 45 |
| 9 | Cherry | 11 |
| 10 | Orange | 56 |

FIG. 5M

Virtual Map For Second Reel, Stop Position 12

| Stop Position | Symbol | Weight |
|---|---|---|
| 7 | 3 Bar | 99 |
| 8 | Blue 7 | 12 |
| 9 | Cherry | 73 |
| 10 | Orange | 56 |
| 11 | Blue 7 | 16 |

120m

FIG. 5N

Virtual Map For Second Reel, Stop Position 13

| Stop Position | Symbol | Weight |
|---|---|---|
| 8 | Blue 7 | 59 |
| 9 | Cherry | 26 |
| 10 | Orange | 79 |
| 11 | Blue 7 | 48 |
| 12 | Jackpot | 44 |

120n

FIG. 5O

Virtual Map For Second Reel, Stop Position 14

| Stop Position | Symbol | Weight |
|---|---|---|
| 9 | Cherry | 53 |
| 10 | Orange | 12 |
| 11 | Blue 7 | 55 |
| 12 | Jackpot | 91 |
| 13 | 3 Bar | 45 |

120o

FIG. 5P

Virtual Map For Second Reel,
Stop Position 15

120p

| Stop Position | Symbol | Weight |
|---|---|---|
| 10 | Orange | 10 |
| 11 | Blue 7 | 71 |
| 12 | Jackpot | 89 |
| 13 | 3 Bar | 75 |
| 14 | Bell | 11 |

FIG. 5Q

Virtual Map For Second Reel,
Stop Position 16

120q

| Stop Position | Symbol | Weight |
|---|---|---|
| 11 | Blue 7 | 98 |
| 12 | Jackpot | 36 |
| 13 | 3 Bar | 101 |
| 14 | Bell | 18 |
| 15 | Cherry | 3 |

FIG. 5R

Virtual Map For Second Reel,
Stop Position 17

120r

| Stop Position | Symbol | Weight |
|---|---|---|
| 12 | Jackpot | 83 |
| 13 | 3 Bar | 109 |
| 14 | Bell | 30 |
| 15 | Cherry | 5 |
| 16 | Red 7 | 29 |

FIG. 5S

Virtual Map For Second Reel,
Stop Position 18

| Stop Position | Symbol | Weight |
|---|---|---|
| 13 | 3 Bar | 105 |
| 14 | Bell | 24 |
| 15 | Cherry | 4 |
| 16 | Red 7 | 23 |
| 17 | Orange | 100 |

120s

FIG. 5T

Virtual Map For Second Reel,
Stop Position 19

| Stop Position | Symbol | Weight |
|---|---|---|
| 14 | Bell | 29 |
| 15 | Cherry | 5 |
| 16 | Red 7 | 21 |
| 17 | Orange | 99 |
| 18 | Bonus | 102 |

120t

FIG. 5U

Virtual Map For Second Reel,
Stop Position 20

| Stop Position | Symbol | Weight |
|---|---|---|
| 15 | Cherry | 4 |
| 16 | Red 7 | 19 |
| 17 | Orange | 51 |
| 18 | Bonus | 93 |
| 19 | Free Shot | 89 |

120u

FIG. 5V

Virtual Map For Second Reel,
Stop Position 21

| Stop Position | Symbol | Weight |
|---|---|---|
| 16 | Red 7 | 24 |
| 17 | Orange | 62 |
| 18 | Bonus | 56 |
| 19 | Free Shot | 65 |
| 20 | 3 Bar | 49 |

120v

FIG. 6A

Virtual Map For Third Reel,
Stop Position 0

130a

| Stop Position | Symbol | Weight |
|---|---|---|
| 17 | Bonus | 77 |
| 18 | Orange | 78 |
| 19 | Free Shot | 48 |
| 20 | Red 7 | 33 |
| 21 | 1 Bar | 20 |

FIG. 6B

Virtual Map For Third Reel,
Stop Position 1

130b

| Stop Position | Symbol | Weight |
|---|---|---|
| 18 | Orange | 77 |
| 19 | Free Shot | 73 |
| 20 | Red 7 | 66 |
| 21 | 1 Bar | 11 |
| 0 | Cherry | 29 |

FIG. 6C

Virtual Map For Third Reel,
Stop Position 2

130c

| Stop Position | Symbol | Weight |
|---|---|---|
| 19 | Free Shot | 51 |
| 20 | Red 7 | 154 |
| 21 | 1 Bar | 27 |
| 0 | Cherry | 16 |
| 1 | Blue 7 | 8 |

FIG. 6D

Virtual Map For Third Reel,
Stop Position 3

130d

| Stop Position | Symbol | Weight |
|---|---|---|
| 20 | Red 7 | 51 |
| 21 | 1 Bar | 154 |
| 0 | Cherry | 27 |
| 1 | Blue 7 | 16 |
| 2 | Red 7 | 8 |

FIG. 6E

Virtual Map For Third Reel,
Stop Position 4

130e

| Stop Position | Symbol | Weight |
|---|---|---|
| 21 | 1 Bar | 15 |
| 0 | Cherry | 86 |
| 1 | Blue 7 | 43 |
| 2 | Red 7 | 58 |
| 3 | Bell | 54 |

FIG. 6F

Virtual Map For Third Reel,
Stop Position 5

130f

| Stop Position | Symbol | Weight |
|---|---|---|
| 0 | Cherry | 77 |
| 1 | Blue 7 | 19 |
| 2 | Red 7 | 16 |
| 3 | Bell | 97 |
| 4 | Free Shot | 47 |

FIG. 6G

Virtual Map For Third Reel,
Stop Position 6

130g

| Stop Position | Symbol | Weight |
|---|---|---|
| 1 | Blue 7 | 35 |
| 2 | Red 7 | 98 |
| 3 | Bell | 55 |
| 4 | Free Shot | 49 |
| 5 | Jackpot | 19 |

FIG. 6H

Virtual Map For Third Reel,
Stop Position 7

130h

| Stop Position | Symbol | Weight |
|---|---|---|
| 2 | Red 7 | 102 |
| 3 | Bell | 49 |
| 4 | Free Shot | 10 |
| 5 | Jackpot | 60 |
| 6 | 1 Bar | 35 |

FIG. 6I

Virtual Map For Third Reel,
Stop Position 8

130i

| Stop Position | Symbol | Weight |
|---|---|---|
| 3 | Blue 7 | 68 |
| 4 | Free Shot | 53 |
| 5 | Jackpot | 26 |
| 6 | 1 Bar | 22 |
| 7 | Orange | 87 |

FIG. 6J

Virtual Map For Third Reel,
Stop Position 9

130j

| Stop Position | Symbol | Weight |
|---|---|---|
| 4 | Free Shot | 51 |
| 5 | Jackpot | 154 |
| 6 | 1 Bar | 27 |
| 7 | Orange | 16 |
| 8 | Free Shot | 8 |

FIG. 6K

Virtual Map For Third Reel,
Stop Position 10

130k

| Stop Position | Symbol | Weight |
|---|---|---|
| 5 | Jackpot | 51 |
| 6 | 1 Bar | 8 |
| 7 | Orange | 27 |
| 8 | Free Shot | 16 |
| 9 | 2 Bar | 154 |

FIG. 6L

Virtual Map For Third Reel,
Stop Position 11

130l

| Stop Position | Symbol | Weight |
|---|---|---|
| 6 | 1 Bar | 20 |
| 7 | Orange | 68 |
| 8 | Free Shot | 69 |
| 9 | 2 Bar | 35 |
| 10 | Bonus | 64 |

FIG. 6M

Virtual Map For Third Reel,
Stop Position 12

130m

| Stop Position | Symbol | Weight |
|---|---|---|
| 7 | Orange | 59 |
| 8 | Free Shot | 64 |
| 9 | 2 Bar | 39 |
| 10 | Bonus | 56 |
| 11 | 3 Bar | 38 |

FIG. 6N

Virtual Map For Third Reel,
Stop Position 13

130n

| Stop Position | Symbol | Weight |
|---|---|---|
| 8 | Free Shot | 78 |
| 9 | 2 Bar | 49 |
| 10 | Bonus | 64 |
| 11 | 3 Bar | 47 |
| 12 | Blue 7 | 18 |

FIG. 6O

Virtual Map For Third Reel,
Stop Position 14

130o

| Stop Position | Symbol | Weight |
|---|---|---|
| 9 | 2 Bar | 61 |
| 10 | Bonus | 52 |
| 11 | 3 Bar | 39 |
| 12 | Blue 7 | 56 |
| 13 | Bonus | 48 |

FIG. 6P

Virtual Map For Third Reel,
Stop Position 15

130p

| Stop Position | Symbol | Weight |
|---|---|---|
| 10 | Bonus | 59 |
| 11 | 3 Bar | 38 |
| 12 | Blue 7 | 61 |
| 13 | Bonus | 48 |
| 14 | Free Shot | 50 |

FIG. 6Q

Virtual Map For Third Reel,
Stop Position 16

130q

| Stop Position | Symbol | Weight |
|---|---|---|
| 11 | 3 Bar | 19 |
| 12 | Blue 7 | 67 |
| 13 | Bonus | 23 |
| 14 | Free Shot | 69 |
| 15 | Bell | 78 |

FIG. 6R

Virtual Map For Third Reel,
Stop Position 17

130r

| Stop Position | Symbol | Weight |
|---|---|---|
| 12 | Blue 7 | 38 |
| 13 | Bonus | 28 |
| 14 | Free Shot | 71 |
| 15 | Bell | 68 |
| 16 | 2 Bar | 51 |

FIG. 6S

Virtual Map For Third Reel,
Stop Position 18

130s

| Stop Position | Symbol | Weight |
|---|---|---|
| 13 | Bonus | 32 |
| 14 | Free Shot | 55 |
| 15 | Bell | 56 |
| 16 | 2 Bar | 65 |
| 17 | Bonus | 48 |

FIG. 6T

Virtual Map For Third Reel,
Stop Position 19

130t

| Stop Position | Symbol | Weight |
|---|---|---|
| 14 | Free Shot | 63 |
| 15 | Bell | 56 |
| 16 | 2 Bar | 40 |
| 17 | Bonus | 56 |
| 18 | Orange | 41 |

FIG. 6U

Virtual Map For Third Reel,
Stop Position 20

130u

| Stop Position | Symbol | Weight |
|---|---|---|
| 15 | Bell | 51 |
| 16 | 2 Bar | 57 |
| 17 | Bonus | 61 |
| 18 | Orange | 58 |
| 19 | Free Shot | 29 |

FIG. 6V

Virtual Map For Third Reel,
Stop Position 21

130v

| Stop Position | Symbol | Weight |
|---|---|---|
| 16 | 2 Bar | 49 |
| 17 | Bonus | 55 |
| 18 | Orange | 68 |
| 19 | Free Shot | 40 |
| 20 | Red 7 | 44 |

FIG. 7

1154a

| | Stop Position | Weight | Weight |
|---|---|---|---|
| | 0 | | |
| BONUS | 1 | | |
| BAR BAR BAR | 2 | | |
| JACKPOT | 3 | | |
| | 4 | | |
| FREE SHOT | 5 | | |
| | 6 | | |
| BLUE | 7 | | |
| BAR | 8 | | |
| RED | 9 | | |
| BAR BAR | 10 | | |
| FREE SHOT | 11 | | |
| | 12 | | |
| BLUE | 13 | | |
| | 14 | | |
| BAR BAR | 15 | | |
| BLUE | 16 | 70 | |
| RED | 17 | 78 | 46 |
| FREE SHOT | 18 | 80 | 68 |
| | 19 | 10 | 59 |
| JACKPOT | 20 | 18 | 19 |
| BAR | 21 | | 64 |

FIG. 8

140

| Symbol Combination | | | Award |
|---|---|---|---|
| Cherry | xx | xx | 1 |
| xx | Cherry | xx | 1 |
| xx | xx | Cherry | 1 |
| Free Shot | Free Shot | Free Shot | Free Spin |
| Cherry | Cherry | xx | 5 |
| Cherry | xx | Cherry | 5 |
| xx | Cherry | Cherry | 5 |
| 1 Bar, 2 Bar, or 3 Bar | 1 Bar, 2 Bar, or 3 Bar | 1 Bar, 2 Bar, or 3 Bar | 5 |
| Cherry | Cherry | Cherry | 10 |
| 1 Bar | 1 Bar | 1 Bar | 10 |
| Orange | Orange | Orange | 20 |
| 2 Bar | 2 Bar | 2 Bar | 25 |
| 3 Bar | 3 Bar | 3 Bar | 40 |
| Bell | Bell | Bell | 50 |
| Blue 7 or Red 7 | Blue 7 or Red 7 | Blue 7 or Red 7 | 60 |
| Blue 7 | Blue 7 | Blue 7 | 100 |
| Red 7 | Red 7 | Red 7 | 200 |
| Jackpot | Jackpot | Jackpot | 1000 |
| Bonus | Bonus | Bonus | 250 |

GAMING SYSTEM AND METHOD PROVIDING ONE OR MORE INDICATIONS ASSOCIATED WITH A PLAYER-SELECTED SYMBOL COMBINATION FOR A PLAY OF A PACHISURO-STYLE SLOT GAME

BACKGROUND

Pachisuro-style gaming machines are well known. Certain known Pachisuro-style gaming machines include a housing that supports three mechanical reels and three input buttons. Each input button is associated with a different one of the mechanical reels. Each mechanical reel includes a plurality of stop positions, each of which includes one of a plurality of different symbols. The housing also supports a protective, see-through glass panel in front of the mechanical reels. A player can see the mechanical reels through the glass when the mechanical reels are spinning, and can see can see one or more of the symbols on each of the mechanical reels through the glass after the mechanical reels stop spinning.

More specifically, in one such known Pachisuro-style gaming machine, after a player places a wager, the gaming machine enables the player to activate an input device that causes the gaming machine to spin each of the mechanical reels. For each of the mechanical reels, the gaming machine enables the player to see that mechanical reel spinning through the glass and to stop that mechanical reel by activating the input button associated with that mechanical reel. When the input button associated with one of the mechanical reels is activated, the gaming machine determines an initiating stop position for that mechanical reel. The gaming machine does not, however, instantaneously stop that mechanical reel at the initiating stop position. Rather, the gaming machine moves that mechanical reel a designated number of stop positions (such as two, three, or four stop positions) past the initiating stop position to an actual stop position. If one or more of a plurality of winning symbol combinations are displayed along one or more paylines after all of the mechanical reels stop spinning, the gaming machine provides the player one or more awards.

When playing such a known Pachisuro-style gaming machine, if a player can readily see the symbols on the mechanical reels through the glass as the mechanical reels are spinning, it is easier for the player to activate the input buttons to cause all three mechanical reels to stop spinning such that one or more desired winning symbol combinations are displayed. Depending on the speed at which the gaming machine spins the mechanical reels, highly skilled players are able to identify opportune times to activate the input buttons to improve those players' chances of stopping the mechanical reels such that the mechanical reels display the desired winning symbol combination(s) and such that the gaming machine provides a corresponding award(s).

Various methods of compensating for such variation in player skill have been developed. A first way to compensate for variation in player skill is to provide reflexive Pachisuro-style gaming machines. Reflexive gaming machines typically increase or decrease a payout associated with a play of a game based on the payout history of that gaming machine. In a simple example of a reflexive Pachisuro-style gaming machine, the desired payback percentage is 90% and the gaming machine tracks its payback percentage for a defined period, such as for 100 games or in between bonus events. The gaming machine stores at least two different paytables having different payback percentages. One is below the target payback percentage (90% in this example) and the other is above it. For instance, Paytable A has a payback percentage of 70% and Paytable B has a payback percentage of 125%. If the actual payback percentage after the first ten tracked games is 150%, the gaming machine will employ Paytable A until the actual payback percentage is less than the target payback percentage of 90%. Once the actual payback percentage falls below the target payback percentage 90%, the gaming machine will 'reflex' and switch to Paytable B to cause the actual payback percentage to increase toward the target payback percentage of 90%. In such case, for a determined number of spins, the gaming machine causes the mechanical reels to stop spinning such that it is more or less likely (depending on which paytable is active) that winning symbol combinations are displayed when the mechanical reels stop spinning, regardless of when the player presses the input buttons associated with each of the mechanical reels. Thus, in this type of reflexive gaming machine, the gaming machine determines whether or not to provide an award for one or more plays of the game based in part on the awards provided for previous plays of the game.

A second way to compensate for variation in player skill is to lower the advantage obtained by highly skilled players by employing virtual mapping to determine the actual stop positions of the mechanical reels. One known Pachisuro-style gaming machine stores, for each mechanical reel, for each stop position of that mechanical reel, a virtual map including a plurality of the stop positions of that mechanical reel. For each virtual map, the gaming machine stores a weight associated with each stop position of that virtual map. When the gaming machine receives an activation of one of the input buttons, the gaming machine determines an initiating stop position for the associated mechanical reel. The gaming system then randomly determines an actual stop position of that mechanical reel based on the weights of the stop positions in the virtual map associated with the initiating stop position. Thus, in this type of Pachisuro-style gaming machine, a highly skilled player's advantage is tempered by the use of the virtual maps and, in particular, the use of random determinations to (in part) determine the actual stop positions of the mechanical reels.

A third way to compensate for variation in player skill is to provide a hint to a player that identifies when the player should activate the input button associated with a particular mechanical reel to maximize the player's expected return. More specifically, in one known Pachisuro-style gaming machine, after at least one but fewer than all of the mechanical reels have stopped spinning, the gaming machine indicates or signals to the player when it is most beneficial for the player to activate the input buttons associated with the remaining mechanical reel(s). That is, the gaming machine indicates or signals to the player when the player should activate the input button(s) associated with the remaining spinning mechanical reel(s) such that the player's expected return (in light of the symbols displayed by the mechanical reel(s) that has already stopped spinning) is maximized. For example, the gaming machine spins three mechanical reels, receives an activation of the input button associated with a first one of the mechanical reels, and stops the first mechanical reel. For each of the second and third mechanical reels, the gaming system flashes a light behind or otherwise associated with that mechanical reel that indicates when the player should activate the input button associated with that mechanical reel such that the player's expected return (in light of the symbols displayed by stopped the first mechanical reel) is maximized. Thus, in this type of Pachisuro-style gaming machine, a lower skilled player is provided an advantage that, at least in part, levels the playing field with respect to more highly skilled players.

However, this third way to compensate for the variation in player skill causes numerous problems in operation. First, this Pachisuro-style gaming machine does not inform or identify to the player which winning symbol combination the gaming machine is attempting to cause the player to cause the gaming machine to display by providing the hints. For instance, if each symbol displayed by a first stopped mechanical reel is associated with a plurality of different winning symbol combinations, and the gaming machine does not inform or identify to the player which of these winning symbol combinations the gaming machine is attempting cause the player to cause the gaming machine to display to maximize the player's expected return. The player does not know whether the gaming machine is attempting to cause the player to cause the gaming machine to display the winning symbol combination having a highest award, the winning symbol combination having a highest probability of being displayed, or the winning symbol combination associated with a maximum expected return.

Second, this Pachisuro-style gaming machine does not provide any hints to the player indicating when the player should activate the input button to stop a first one of the mechanical reels from spinning. This gaming machine instead provides such hints after the player has stopped the first mechanical reel and has possibly eliminated the chance for the player to achieve one or more desired winning symbol combinations. Third, such hints may distract players whose strategy for stopping the mechanical reels differs from the "maximum expected return" strategy implemented by the gaming machine. For instance, a player may desire to stop the mechanical reels such that a winning symbol combination associated with a high probability of occurrence and a low award is displayed. In this example, the winning symbol combination desired by the player is not the winning symbol combination that will maximize the player's expected return. Thus, in this example, the hints provided by the gaming machine will distract the player and make it more difficult for the player to stop the mechanical reels such that the player's desired winning symbol combination is displayed.

Accordingly, a continuing need exists for a Pachisuro-style gaming machine that enables players of all skill levels to enjoy Pachisuro-style gaming.

SUMMARY

Various embodiments of the present disclosure are directed to gaming systems and methods providing one or more indications associated with a player-selected winning symbol combination for a play of a Pachisuro-style slot game. Generally, one embodiment of the gaming system of the present disclosure includes a housing supporting a plurality of reels, each of which includes a plurality of symbols, and a separate stop input device associated with each reel. For a play of the Pachisuro-style slot game, while each reel is spinning, the gaming system enables the player to activate the stop input device associated with that reel to cause the gaming system to stop that reel from spinning. The gaming system enables a player to select a desired one of a plurality of different winning combinations of the symbols on the reels. The gaming system spins the reels and, while the reels are spinning, indicates or signals when the player should activate the stop input devices to cause the gaming system to stop the reels such that a probability of the desired winning symbol combination being displayed is maximized.

More specifically, in one embodiment, the gaming system includes at least one display device including a plurality of reels. Each reel includes a plurality of stop positions, and each stop position is associated with one of a plurality of different symbols. The gaming system includes a plurality of input devices including a separate stop input device for each reel. For each reel, for each stop position of that reel, the gaming system stores a virtual map including a plurality of the stop positions of that reel, wherein each of the plurality of the stop positions is associated with one of a plurality of different weights. The gaming system also stores a paytable including a plurality of different winning symbol combinations, each of which is associated with one of a plurality of different awards.

For a play of the Pachisuro-style slot game, the gaming system receives, from the player, an input associated with a desired one of the winning symbol combinations. For example, the gaming system receives an input associated with one of: the winning symbol combination associated with a highest award, the winning symbol combination associated with a highest probability of being displayed, the winning symbol combination associated with a highest expected return, and the winning symbol combination associated with a bonus trigger. The gaming system starts spinning each of the reels.

For at least one reel, while that reel is spinning, the gaming system enables the player to activate the stop input device associated with that reel to cause an initiating stop position to be determined. The gaming system provides an indication when the player should activate the stop input device associated with that reel such that a probability of the desired winning symbol combination being displayed is maximized. The gaming system receives an activation of the stop input device associated with that reel and determines the initiating stop position based on the activation. The gaming system determines an actual stop position of that reel based on the weights associated with the stop positions in the virtual map associated with the determined initiating stop position, and stops that reel at the determined actual stop position. That is, the gaming system randomly determines the stop position at which that reel ultimately stops based on the virtual map associated with the initiating stop position.

After the reels stop spinning, the gaming system determines if any of the winning symbol combinations are displayed, and provides the awards associated with any displayed winning symbol combinations.

It should be appreciated that, in certain embodiments, the gaming system provides the indication for each and every reel, while in other embodiments the gaming system provides the indication for fewer than all of the reels.

It should thus be appreciated that the gaming system of the present disclosure solves the above-described problems by compensating for variation in player skill while: (a) enabling the player to choose the winning symbol combination the gaming system attempts to cause the player to cause the gaming system to display by providing the indications, which reduces player confusion and eliminates distractions caused by undesired indications; and (b) in certain embodiments, providing such indications for each and every one of the reels rather than fewer than all of the reels.

Additional features and advantages are described herein, and will be apparent from, the following Detailed Description and the Figures.

BRIEF DESCRIPTION OF THE FIGURES

FIG. 2 illustrates a table including, for each of three example reel strips of one embodiment of the gaming system of the present disclosure, the stop positions associated with that reel strip and the symbol associated with each stop position.

FIGS. 4A, 4B, 4C, 4D, 4E, 4F, 4G, 4H, 4I, 4J, 4K, 4L, 4M, 4N, 4O, 4P, 4Q, 4R, 4S, 4T, 4U and 4V respectively illustrate the virtual map associated with each stop position of a first example reel of one embodiment of the gaming system of the present disclosure.

FIGS. 5A, 5B, 5C, 5D, 5E, 5F, 5G, 5H, 5I, 5J, 5K, 5L, 5M, 5N, 5O, 5P, 5Q, 5R, 5S, 5T, 5U and 5V respectively illustrate the virtual map associated with each stop position of a second example reel of one embodiment of the gaming system of the present disclosure.

FIGS. 6A, 6B, 6C, 6D, 6E, 6F, 6G, 6H, 6I, 6J, 6K, 6L, 6M, 6N, 6O, 6P, 6Q, 6R, 6S, 6T, 6U and 6V respectively illustrate the virtual map associated with each stop position of a third example reel of one embodiment of the gaming system of the present disclosure.

FIG. 7 illustrates the reel strip associated with the first reel of FIG. 2 in relation to the stop positions of the first reel and the weights associated with the stop positions of the virtual maps associated with two of the stop positions of the first reel.

FIG. 8 illustrates an example paytable employed by one embodiment of the gaming system of the present disclosure.

DETAILED DESCRIPTION

The present disclosure is directed to a gaming system and method providing one or more indications associated with a player-selected winning symbol combination for a play of a Pachisuro-style slot game. While the Pachisuro-style slot game is a primary wagering game in the embodiments described below, it should be appreciated that the Pachisuro-style slot game of the present disclosure may additionally or alternatively be employed as or in association with a secondary game or a bonus game. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

The manner in which certain embodiments of the gaming system of the present disclosure employ virtual maps to determine the actual stop positions of the reels is explained below, followed by an explanation of the manners in which certain embodiments of the gaming system of the present disclosure provide indications associated with a player-selected winning symbol combination for a play of the Pachisuro-style slot game.

Figure 1A:
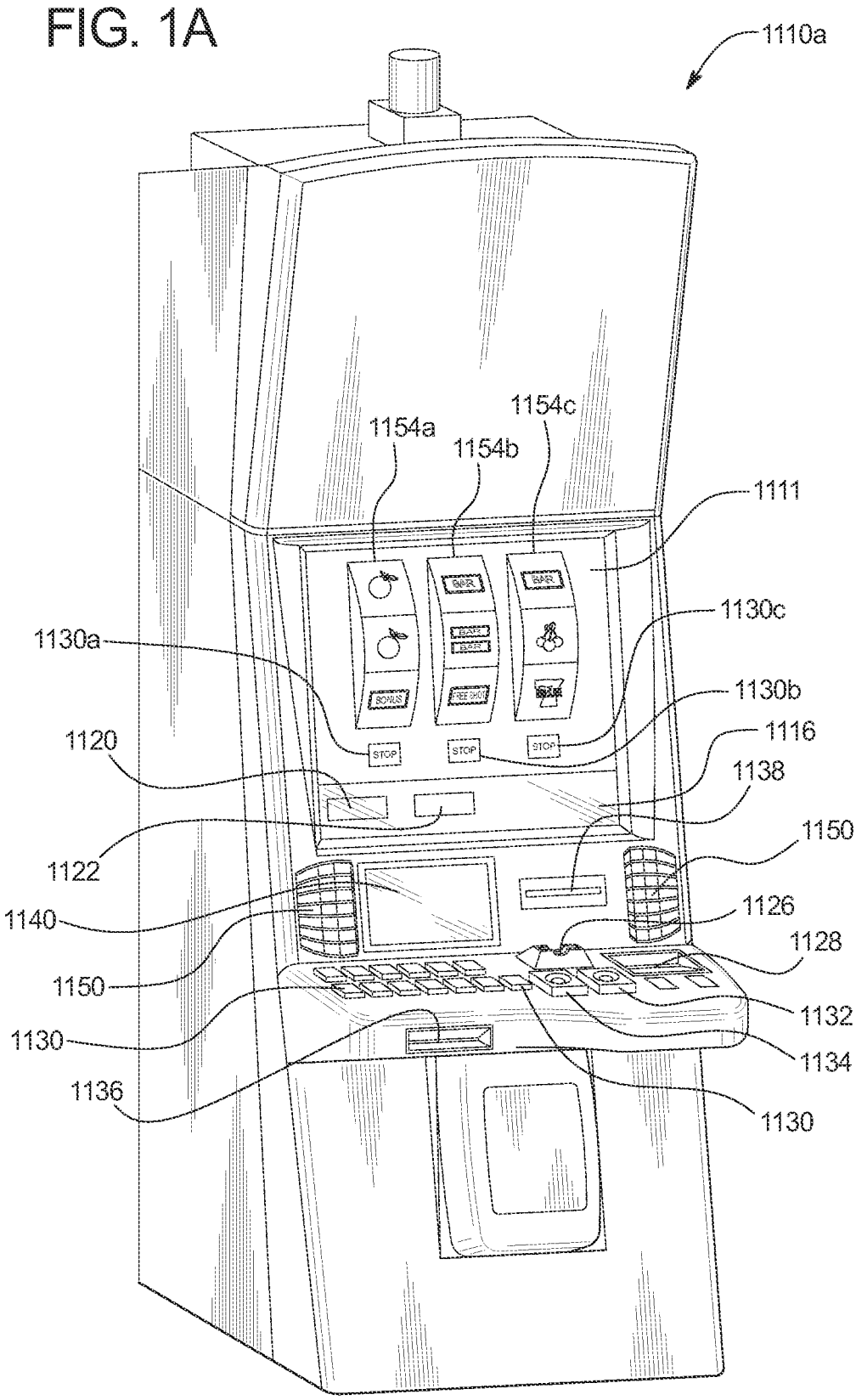
FIGS. 1A and 1B are perspective views of example alternative embodiments of the gaming system of the present disclosure.
Figure 1B:
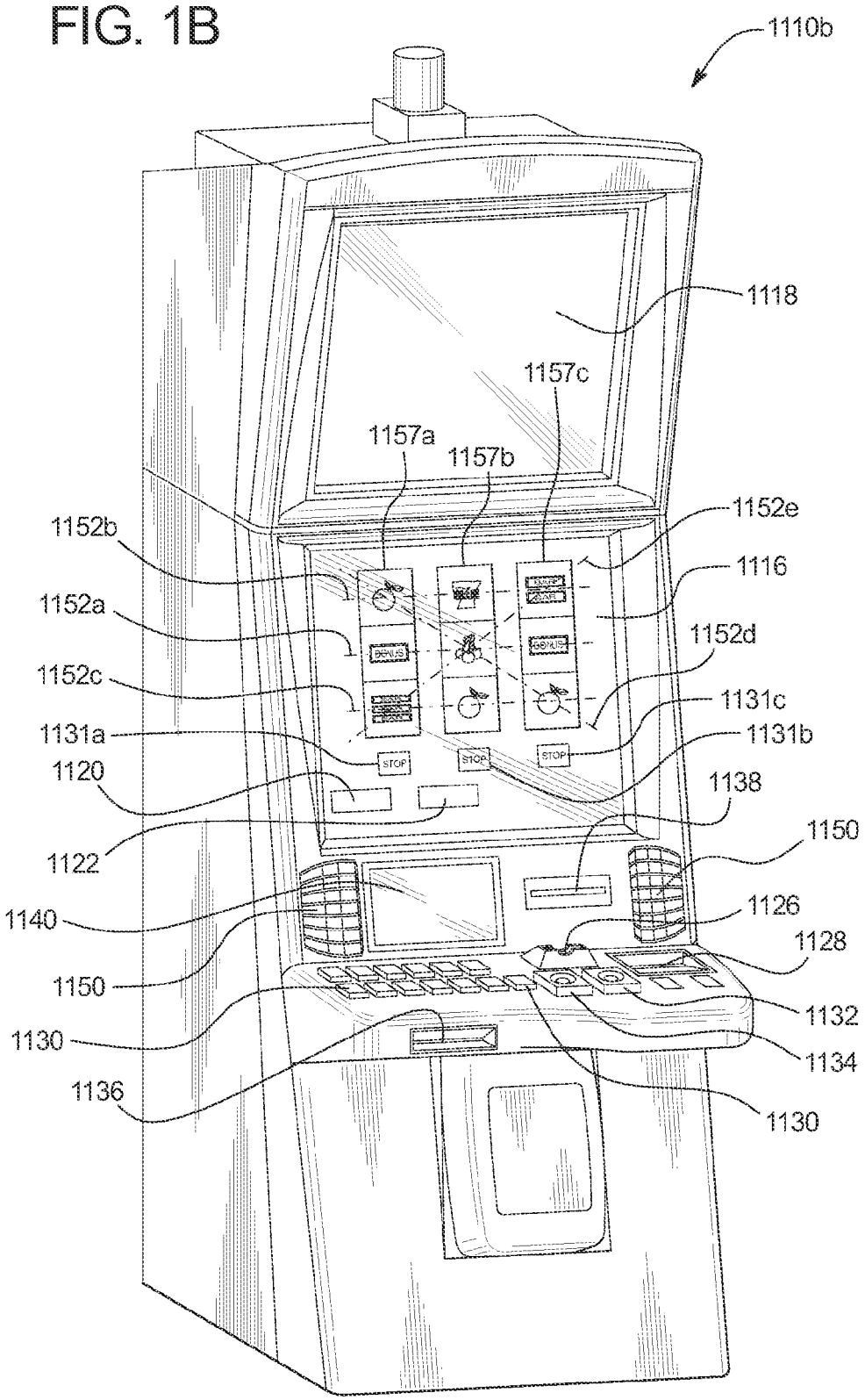

Determining the Actual Stop Positions of Spinning Reels Based on the Virtual Maps Associated with the Reels FIG. 1A illustrates an example embodiment of a gaming system 1110*a* (described in detail below) including a housing 1111 that supports three mechanical reels including a first reel 1154*a*, a second reel 1154*b*, and a third reel 1154*c*. While first reel 1154*a*, second reel 1154*b*, and third reel 1154*c* are mechanical reels in the embodiment illustrated in FIG. 1A, it should be appreciated that the reels are video reels in other embodiments. For example, FIG. 1B illustrates another example embodiment of a gaming system 1110*b* (described in detail below) that includes video reels including a first reel 1157*a*, a second reel 1157*b*, and a third reel 1157*c*. It should be appreciated that the gaming system (and Pachisuro-style slot game) may include or be associated with any suitable type or types of reels and any suitable quantity of reels (such as three to five reels).

In this embodiment, each reel includes twenty-two stop positions numbered 0 to 21. Each stop position is associated with one of a plurality of different symbols. FIG. 2 illustrates a table 100 including: (a) the reel strips for first reel 1154*a*, second reel 1154*b*, and third reel 1154*c*; and (b) for each of first reel 1154*a*, second reel 1154*b*, and third reel 1154*c*, the stop positions of that reel and, for each of the stop positions, the symbol associated with that stop position. It should be appreciated that each reel may include any suitable quantity of stop positions, that the stop positions of each reel may be numbered in any suitable manner, and that the stop positions may be associated with any suitable symbol or symbols.

Housing 1111 of gaming system 1110*a* also supports a plurality of stop input devices including a first stop input device 1130*a*, a second stop input device 1130*b*, and a third stop input device 1130*c*. Each of the stop input devices is associated with a different one of the reels. Specifically, in this embodiment, first reel 1154*a* is associated with first stop input device 1130*a*, second reel 1154*b* is associated with second stop input device 1130*b*, and third reel 1154*c* is associated with third stop input device 1130*c*. Each stop input device enables a player to, while the reel associated with that stop input device is spinning, cause the gaming system to stop that reel from spinning by activating that stop input device.

First stop input device 1130*a*, second stop input device 1130*b*, and third stop input device 1130*c* of gaming system 1110*a* are separate electromechanical input devices or buttons. In other embodiments, the stop input devices are selections on a touch screen or any other suitable video-based selections. For instance, gaming system 1110*b* (shown in FIG. 1B) includes a plurality of touch screen selection stop input devices including a first stop input device 1131*a*, a second stop input device 1131*b*, and a third stop input device 1131*c*. In further embodiments, the gaming system includes a single stop input device that serves the function of each of the stop input devices described above. For instance, the gaming system includes a single stop input device that, when sequentially activated three separate times, causes each of the three reels to stop spinning. In should be appreciated that the gaming system may employ any suitable input device or devices.

Figure 3:
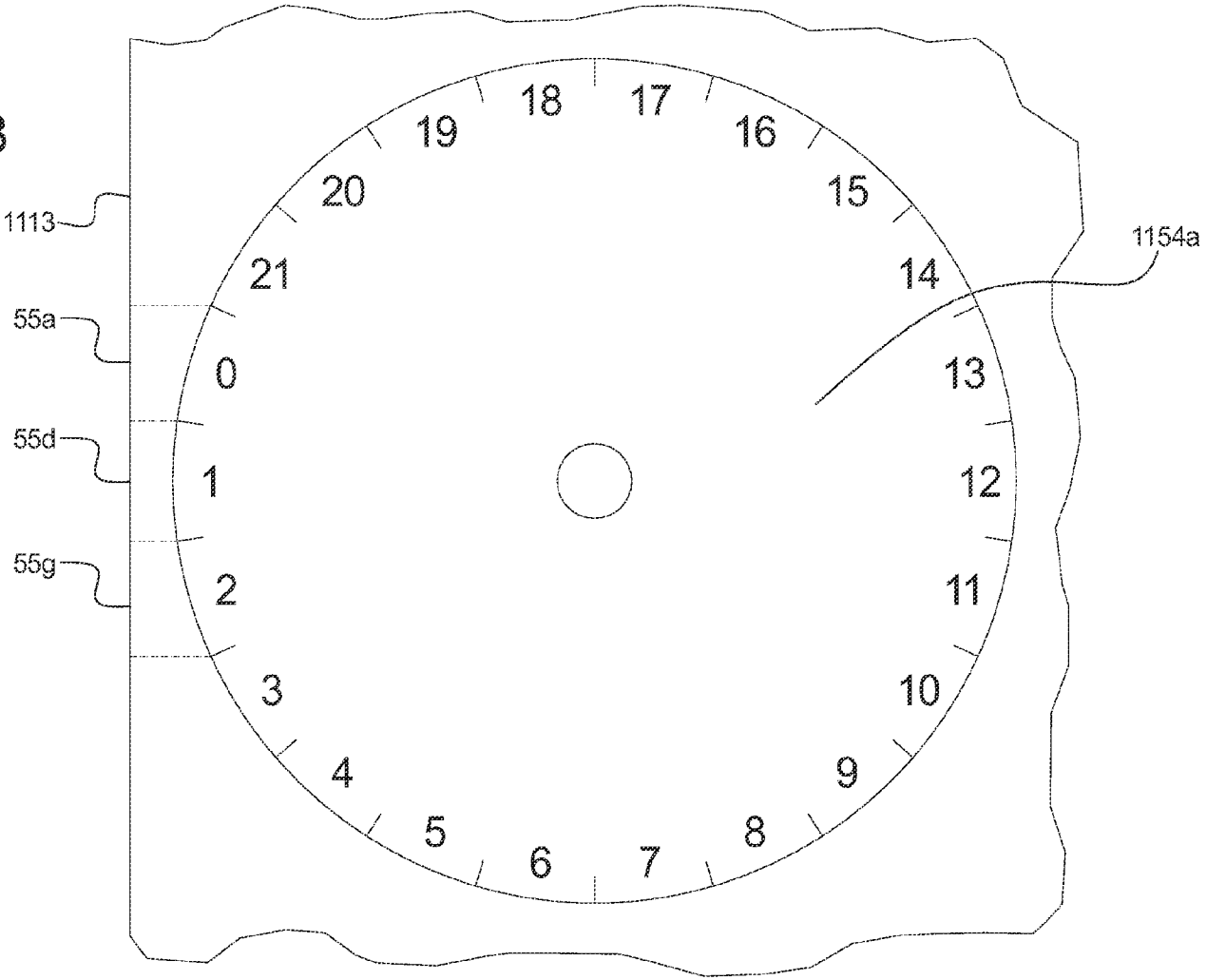
FIG. 3 illustrates a side view of a reel relative to a plurality of symbol display areas of one embodiment of the gaming system of the present disclosure.

Housing 1111 of gaming system 1110*a* also supports a panel 1113 (such as a glass or plastic panel). Panel 1113 defines a plurality of symbol display areas 55*a* to 55*i*, which are shown in FIGS. 10A to 10H, described below. In this embodiment, three stop positions of each of the reels are visible at respective symbol display areas defined by panel 1113. For instance, as shown in FIG. 3, the symbol associated with stop position 0 of first reel 1154*a* is displayed at symbol display area 55*a*, the symbol associated with stop position 1 of first reel 1154*a* is displayed at symbol display area 55*d*, and the symbol associated with stop position 2 of first reel 1154*a* is displayed at symbol display area 55*g*. It should be appreciated that, as explained in detail below, the symbols on the reels that are displayed at the symbol display areas after the reels are spun and stopped are determined based on the actual stop positions of the reels. It should be appreciated that the gaming system may include or be associated with any suitable quantity of symbol display areas. It should also be appreciated that each reel may be associated with any suitable quantity of symbol display areas configured to display symbols of that reel.

For each spinning reel, the gaming system randomly determines the stop position at which that reel ultimately stops spinning (i.e., determines the actual stop position of that reel) based on a virtual map associated with a stop position of that reel that the gaming system determines to be an initiating stop position based on the player's activation of the stop input device for that reel. As used herein, the term "initiating stop position" of a reel is used to describe the stop position of that reel that is at or is the first to be at a predetermined area, position, or reference point when the gaming system receives an activation of the stop input device associated with that reel. In one embodiment, the predetermined area, position, or reference point is in one of a plurality of symbol display areas. As described above, the symbol display areas are the positions at which certain of the symbols on the reels are displayed to or visible to the player. Thus, each time a reel spins and the gaming system receives an activation of the stop input device associated with that reel, one of the stop positions of that reel is determined to be the initiating stop position for that spin of that reel, and the gaming system uses the virtual map associated with that stop position to determine the actual stop position of that reel. It should be appreciated that each of the stop positions of a given reel may be the initiating stop position for that reel.

In various embodiments, each virtual map includes a range of a plurality of the stop positions of the reel with which that virtual map is associated (i.e., the reel that includes the stop position with which that virtual map is associated). Each stop position in the range of the stop positions is associated with one of a plurality of different weights. In certain embodiments, the range of the stop positions in each virtual map includes fewer than all of the stop positions of the reel with which that virtual map is associated. It should be appreciated that, in other embodiments, a given virtual map includes all of the stop positions of the reel with which that virtual map is associated. In certain embodiments, at least two of the virtual maps are different, while in other embodiments at least two of the virtual maps are the same. It certain embodiments, each stop position of a given virtual map is associated with a different weight, while in other embodiments at least two of the stop positions of a given virtual map are associated with a same weight. In various embodiments, all of the stop positions in a given virtual map are associated with a same weight. In one embodiment, each stop position of each virtual map of at least one, but not all, of the reels is associated with a same weight. In certain embodiments, a plurality of the stop positions of a given reel are each associated with a same virtual map. Thus, in such embodiments, each stop position of each reel is not associated with a different virtual map. In various embodiments, the sums of the weights associated with the stop positions of two of the virtual maps are different. In various other embodiments, two virtual maps include ranges of the stop positions of the reels with which those virtual maps are associated that include different numbers of stop positions. For instance, one virtual map is associated with a range of four of the stop positions of the associated reel, while another virtual map is associated with a range of six of the stop positions of the associated reel.

The gaming system uses the virtual map associated with the determined initiating stop position of a spinning reel to randomly determine an actual stop position for that reel based on the weights associated with the stop positions in that virtual map in any of a variety of suitable manners. In one embodiment, the gaming system randomly determines the actual stop position of a spinning reel by generating a random number. In one such example, a designated stop position of a reel is associated with a virtual map that includes a first stop position having a weight of 10, a second stop position having a weight of 20, and a third stop position having a weight of 30. The gaming system determines the designated stop position to be the initiating stop position for the reel, and the gaming system randomly generates a number between 1 and 60 (i.e., the sum of the weights 10, 20, and 30). The gaming system employs the randomly generated number to determine the stop position at which to stop the reel (i.e., to determine the actual stop position of the reel). If the gaming system randomly generates a number between 1 and 10, the gaming system causes the reel to stop at the first stop position (i.e., determines the first stop position as the actual stop position). If the gaming system randomly generates a number between 11 and 30, the gaming system causes the reel to stop at the second stop position (i.e., determines the second stop position as the actual stop position). If the gaming system randomly generates a number between 31 and 60, the gaming system causes the reel to stop at the third stop position (i.e., determines the third stop position as the actual stop position). In this example, although the gaming system randomly determines a number, it should be appreciated that by adjusting the weights assigned to each stop position of the virtual map, the probability of the gaming system randomly selecting each respective stop position in the virtual map can be adjusted. In certain embodiments, the gaming system randomly generates the number after the gaming system receives an activation of the stop input device associated with the reel, while in other embodiments the gaming system randomly generates the number before the gaming system receives an activation of the stop input device for the reel.

FIGS. 4A to 4V illustrate a plurality of example virtual maps 110*a* to 110*v* respectively associated with stop positions 0 to 21 of first reel 1154*a*. For instance, virtual map 110*a* is associated with stop position 0 of first reel 1154*a*, virtual map 110*b* is associated with stop position 1 of first reel 1154*a*, and so on. Virtual map 110*a* includes a range of five of the stop positions of first reel 1154*a* including stop positions 17 to 21 of first reel 1154*a*. Stop position 21 follows directly behind stop position 0 as first reel 1154*a* spins (counter-clockwise in this example), and stop position 17 is five symbol positions away from stop position 0. Stop position 17 is associated with a weight of 46, stop position 18 is associated with a weight of 68, stop position 19 is associated with a weight of 59, stop position 20 is associated with a weight of 19, and stop position 21 is associated with a weight of 64. In this embodiment, during a play of the Pachisuro-style slot game, while first reel 1154*a* is spinning, if the gaming system determines stop position 0 to be the initiating stop position of first reel 1154*a*, the gaming system will stop first reel 1154*a* at one of stop positions 17 to 21.

Similarly, FIGS. 5A to 5V illustrate a plurality of example virtual maps 120*a* to 120*v* respectively associated with stop positions 0 to 21 of second reel 1154*b*. The gaming system uses virtual maps 120*a* to 120*v* to determine at which of a respective range of stop positions second reel 1154*b* actually stops after the gaming system receives an activation of second stop input device 1130*b* while second reel 1154*b* is spinning. FIGS. 6A to 6V illustrate a plurality of example virtual maps 130*a* to 130*v* respectively associated with stop positions 0 to 21 of third reel 1154*c*. The gaming system uses virtual maps 130*a* to 130*v* to determine at which of a respective range of stop positions third reel 1154*c* actually stops after the gaming system receives an activation of third stop input device 1130*c*.

The predetermined position for the purposes of determining the initiating stop position (as defined above) of first reel 1154*a* in this embodiment is defined by symbol display area 55*d*. In this embodiment, a stop position is at symbol display area 55*d* if the symbol associated with that stop position is within the area defined by symbol display area 55*d* when the gaming system receives an activation of stop input device 1130*a*. In certain instances, however, a symbol may not be perfectly aligned with symbol display area 55*d* at the time the gaming system receives an activation of stop input device 1130*a*. For example, a symbol could be half positioned at symbol display area 55*a* and half positioned at symbol display area 55*d*. In such a scenario, in this embodiment, the stop position associated with the symbol after such symbol on the reel strip for first reel 1154*a* would be the first to be at the predetermined position when the gaming system receives an activation of stop input device 1130*a*. Similarly, the predetermined position for the purposes of determining the initiating stop position of second reel 1154*b* in this embodiment is defined by symbol display area 55*e* and the predetermined position for the purposes of determining the initiating stop position of third reel 1154*c* in this embodiment is defined by symbol display area 55*f*.

It should be appreciated that, in other embodiments, at least two, but fewer than all, of the reels employ different points of reference for determining the initiating stop positions of those reels. In one such embodiment, each reel employs a different point of reference for determining the initiating stop position for that reel for each spin of that reel. For example, the top symbol display area associated with one reel is used as the point of reference for determining the initiating stop position of that reel, the middle symbol display area associated with another reel is used as the point of reference for determining the initiating stop position of that reel, and the bottom symbol display area associated with another reel is used as the point of reference for determining the initiating stop position of that reel. In certain embodiments, instead of using one or more symbol display areas as points of reference for determining the initiating stop positions of the reels, the gaming system employs a predetermined reference line or lines (such as paylines) to determine the initiating stop positions of one or more reels. It should also be appreciated that any suitable reference point or points may be employed to determine the initiating stop positions.

In the embodiment illustrated in FIGS. 1A and 3 if the gaming system receives an activation of stop input device 1130*a* associated with first reel 1154*a* when the symbol associated with stop position 0 is positioned within display area 55*d*, the gaming system determines stop position 0 as the initiating stop position and uses virtual map 110*a* (illustrated in FIG. 4A) to randomly determine at which of stop positions 17 to 21 of first reel 1154*a* will stop (i.e., which of stop positions 17 to 21 is the actual stop position) based on the weights associated with stop positions 17 to 21 in virtual map 110*a*. The sum of the weights associated with each of the stop positions in virtual map 110*a* is 256. In this example, the gaming system randomly generates a number between 1 and 256. If the randomly generated number is between 1 and 46, the gaming system causes first reel 1154*a* to stop at stop position 17 (i.e., determines stop position 17 to be the actual stop position of first reel 1154*a*). If the randomly generated number is between 47 and 114, the gaming system causes first reel 1154*a* to stop at stop position 18 (i.e., determines stop position 18 to be the actual stop position of first reel 1154*a*). If the randomly generated number is between 115 and 173, the gaming system causes first reel 1154*a* to stop at stop position 19 (i.e., determines stop position 19 to be the actual stop position of first reel 1154*a*). If the randomly generated number is between 174 and 192, the gaming system causes first reel 1154*a* to stop at stop position 20 (i.e., determines stop position 20 to be the actual stop position of first reel 1154*a*). If the randomly generated number is between 193 and 256, the gaming system causes first reel 1154*a* to stop at stop position 21 (i.e., determines stop position 21 to be the actual stop position of first reel 1154*a*). It should be appreciated that, in this example, the symbol associated with the determined actual stop position is displayed at symbol display area 55*d*.

The above is an example of a random number generation method which could be implemented by the gaming system to randomly determine the actual stop position according to the weights in virtual map 110*a*. It should be appreciated that in any of the embodiments described herein, any suitable random number generation technique utilizing the weights or different probabilities associated with the virtual maps may be used to randomly determine the actual stop positions of the reels. For example, in various other embodiments, the gaming system randomly generates a number larger than the sum of the weights for a virtual map and the number is scaled down to a number within the sum of the weights for the virtual map based on a suitable mathematical conversion.

In this example, although the gaming system randomly determines a number, it should be appreciated that by adjusting the weights associated with each stop position of a virtual map, the likelihood of the gaming system randomly selecting each stop position in the virtual map can be adjusted. For example, according to virtual map 110*a*, if the gaming system receives an activation of stop input device 1130*a* when the "Orange" symbol associated with stop position 0 of first reel 1154*a* is displayed at symbol display area 55*d* (i.e., when stop position 0 is the initiating stop position of first reel 1154*a*), the gaming system is most likely to stop first reel 1154*a* at stop position 18 such that the "Free Shot" symbol is displayed at symbol display area 55*d*. This likelihood by shifting the weights associated with the stop positions in virtual map 110*a*.

FIG. 7 illustrates a partial representation of the relationship between stop positions 0 and 21 of first reel 1154*a* and virtual maps 110*a* and 110*v* respectively associated with those stop positions. In this embodiment, if the gaming system determines stop position 21 of first reel 1154*a* to be the initiating stop position for first reel 1154*a*, the gaming system causes first reel 1154*a* to spin at least one but no more than five additional stop positions before stopping at one of stop positions 16 to 20. If the gaming system determines stop position 0 to be the initiating stop position for first reel 1154*a*, the gaming system causes first reel 1154*a* to spin at least one but no more than five additional stop positions before stopping at one of stop positions 17 to 21. The lag of at least one stop position is caused by mechanical limitations due to the laws of physics and is based on the exact portion of the symbol associated with the stop position located at the predetermined location (e.g., symbol display area) being indicated. It should be appreciated that, in various other embodiments, the number of stop positions after the initiating stop position and before the first stop position in the range of stop positions in the virtual map associated with the initiating stop position may be any suitable number of stop positions.

In other embodiments in which one or more reels are mechanical reels, the gaming system determines the initiating stop position(s) for the mechanical reel(s) based on a step count of a step motor associated with that (those) mechanical reel(s). For example, in one embodiment, the step motor associated with a mechanical reel that includes twenty-two stop positions includes 132 steps, six for each stop position of the mechanical reel. In this example, stop position 0 is associated with steps 1 to 6, stop position 1 is associated with steps 7 to 12, and so on. In this example, if the gaming system receives an activation of the stop input device associated with the mechanical reel when the step motor is at step 9, stop position 1 is the initiating stop position. It should be appreciated that, in such embodiments, the step motor may include any suitable number of steps. It should further be appreciated that the gaming system may determine the initiating stop positions for the reels in any other suitable manner.

It should be appreciated that, in various embodiments, a plurality of variables influence the ability of a mechanical reel to stop at a desired number of stop positions (e.g., one or two) following an initiating stop position, including: (a) the size of the mechanical reel, (b) the size of the symbols on the reel strip associated with the mechanical reel, and (c) the speed of the mechanical reel when the gaming system receives an activation of the stop input device associated with the mechanical reel. In various embodiments, the number of stop positions past the initiating stop position at which a reel is able to stop and the number of stop positions in the range of one or more virtual maps may vary based on variations in these variables. Additionally, in various other embodiments, the number of stop positions after the initiating stop position for a respective reel before the first stop position in the range of stop positions for the virtual map associated with the initiating stop position may be different for different reels.

FIG. 8 illustrates a paytable 140 for one embodiment of the Pachisuro-style slot game. Paytable 140 has an average expected payback percentage. In this embodiment, the average expected payback percentage of paytable 140 is based on a component paytable for each of the 10,648 possible combinations of virtual maps. More specifically, each possible combination of virtual maps (based on each one of the possible initiating stop positions of each respective reel) has its own component paytable (not shown). In an example embodiment of the gaming system including three reels each having 22 stop positions, the memory devices stores 66 virtual maps (i.e., one for each of the 22 stop positions on each of the three reels), and 10,648 (i.e., 22×22×22) component paytables are used to create these 66 virtual maps. The 10,648 component paytables are configured so each one of them results in an average expected payback percentage within the desired range and to achieve a designated average expected payback percentage for the overall paytable of the game.

The average expected payback percentage of each respective component paytable in this embodiment is between 80% and 95%. Thus, the average expected payback percentage of paytable 140 is between 80% and 95%. More specifically, in this embodiment, the average expected payback percentage of paytable 140 is the average of the average expected payback percentages of the respective component paytables. It should be appreciated that, in various embodiments, the range of average expected payback percentages for each respective component paytable may be any suitable range. It should also be appreciated that in this embodiment, the upper range of the average expected payback percentage stops at 95% to enable the gaming provider to receive funds to ultimately provide back to players in the form of progressive awards, bonus awards, or any other suitable form. At least U.S. Patent Application Publication Nos. 2010/0234089 and 2010/0234091 further describe the use of component paytables.

Configuring the virtual maps such that the payback percentages of the component paytables are within a designated range of payback percentages makes Pachisuro-style gaming entertaining and exciting for players of all levels. No matter how poorly a player plays, or when the player plays the gaming system relative to another player, the player is guaranteed at least the lowest payback percentage of the designated range of payback percentages for the component paytables.

The embodiments of the Pachisuro-style slot game disclosed herein do not, however, prevent skilled players from obtaining an advantage over unskilled players. Rather, in certain embodiments, the gaming system enables highly skilled players to achieve higher payback percentages than unskilled players. Specifically, if the player can identify the stop positions as the gaming system receives an activation of the stop input devices, the player can target certain combinations of stop positions. For example, over time, a highly skilled player may recognize that when the player activates the stop input devices when certain symbols are displayed, the player repeatedly receives high awards, even if not frequently (a high volatility experience), or receive low awards frequently (a low volatility experience). Thus, the player may try to repeatedly activate the stop input devices when these symbols are displayed. In this example, the highly skilled player has identified a combination of stop positions associated with a component paytable that has a high payback percentage.

Providing One or More Indications Associated with a Player-Selected Winning Symbol Combination for a Play of a Pachisuro-Style Slot Game As described above, in certain embodiments the gaming system of the present disclosure includes a housing supporting a plurality of mechanical reels, each of which includes a plurality of symbols, and a separate stop input device associated with each reel. For a play of the Pachisuro-style slot game of the present disclosure, while each reel is spinning, the gaming system enables the player to activate the stop input device associated with that reel to cause the gaming system to stop that reel from spinning. The gaming system enables a player to select a desired one of a plurality of different winning combinations of the symbols on the reels. The gaming system spins the reels and, while the reels are spinning, indicates or signals when the player should activate the stop input devices to cause the gaming system to stop the reels such that a probability of the desired winning symbol combination being displayed is maximized. In one embodiment, described in detail below, the gaming system indicates or signals when the player should activate the stop input devices associated with the reels such that a probability of the desired winning symbol combination being displayed along a wagered-on payline is maximized.

Figure 9:
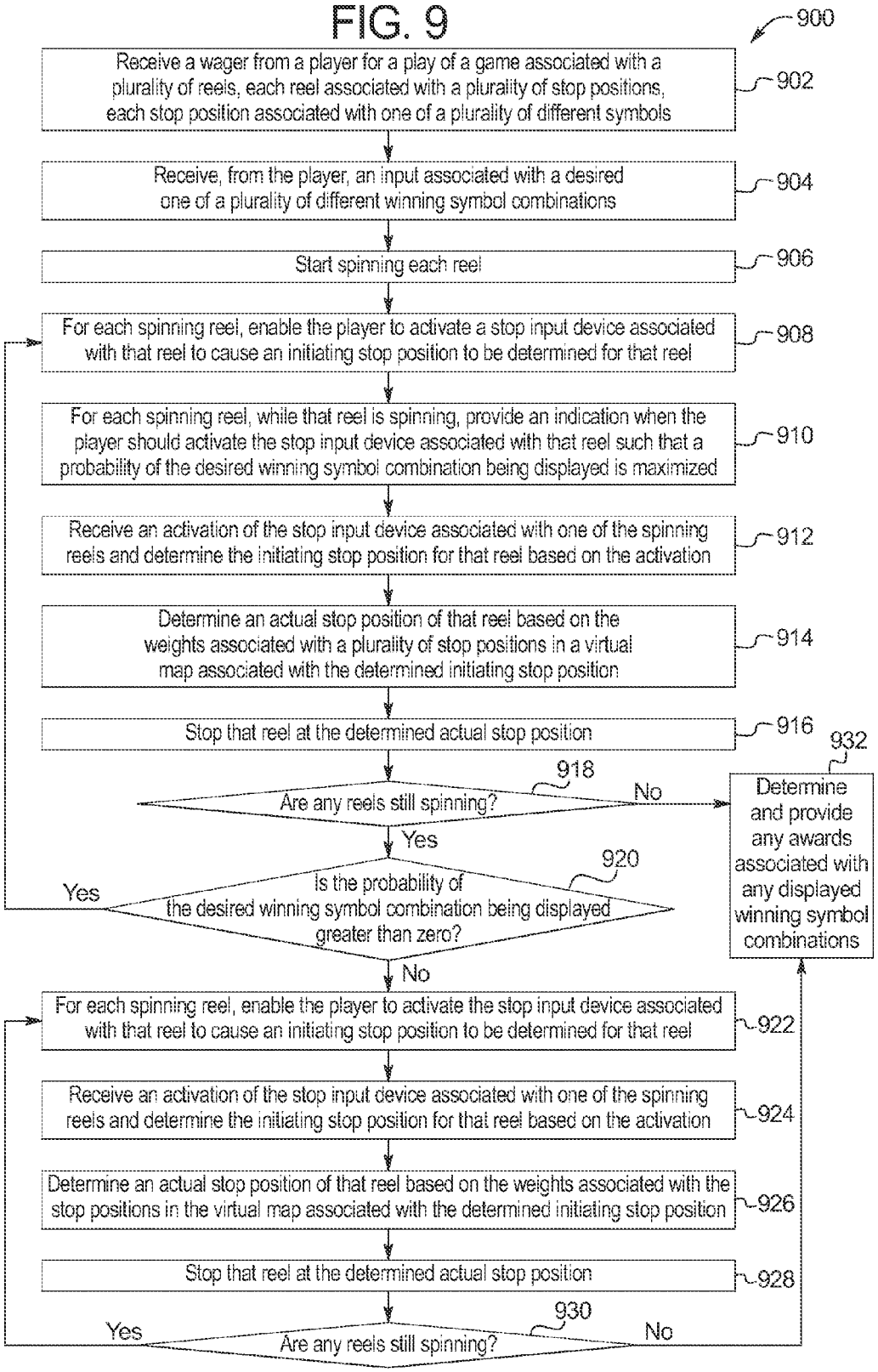
FIG. 9 a flowchart illustrating an example method of operating one embodiment of the gaming system of the present disclosure.

FIG. 9 illustrates a flowchart of an example process or method 900 of operating the gaming system of the present disclosure. In various embodiments, process 900 is represented by a set of instructions stored in one or more memories and executed by one or more processors. Although process 900 is described with reference to the flowchart shown in FIG. 9, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In this example, the gaming system is configured to operate a Pachisuro-style slot game associated with a plurality of reels. Each reel includes a plurality of stop positions, each of which is associated with one of a plurality of different symbols. For each reel, for each stop position of that reel, the gaming system stores a virtual map including a plurality of the stop positions of that reel, wherein each of the plurality of the stop positions is associated with one of a plurality of different weights. The gaming system receives a wager from a player for a play of the Pachisuro-style slot game, as indicated by block 902. The gaming system receives, from the player, an input associated with a desired one of a plurality of different winning symbol combinations, as indicated by block 904. Each winning symbol combination is associated with one of a plurality of different awards. The gaming system starts spinning each reel, as indicated by block 906.

For each spinning reel, the gaming system enables the player to activate a stop input device associated with that reel to cause an initiating stop position to be determined for that reel, as indicated by block 908. For each spinning reel, while that reel is spinning, the gaming system provides an indication when the player should activate the stop input device associated with that reel such that a probability of the desired winning symbol combination being displayed is maximized, as indicated by block 910. The gaming system receives an activation of the stop input device associated with one of the spinning reels and determines the initiating stop position for that reel based on the activation, as indicated by block 912. The gaming system determines an actual stop position of that reel based on the weights associated with the stop positions in the virtual map associated with the determined initiating stop position, as indicated by block 914. The gaming system stops that reel at the determined actual stop position, as indicated by block 916.

The gaming system determines whether any reels are still spinning, as indicated by diamond 918. If the gaming system determines that all of the reels have stopped spinning, process 900 proceeds to block 932, described below. If the gaming system instead determines that at least one reel is still spinning, the gaming system determines whether the probability of the desired winning symbol combination being displayed is greater than zero, as indicated by diamond 920. If the gaming system determines that the probability of the desired winning symbol combination being displayed is greater than zero, process 900 returns to block 908.

If, on the other hand, the gaming system determines that the probability of the desired winning symbol combination being displayed is zero, for each spinning reel, the gaming system enables the player to activate the stop input device associated with that reel to cause an initiating stop position to be determined for that reel, as indicated by block 922. The gaming system receives an activation of the stop input device associated with one of the spinning reels and determines the initiating stop position for that reel based on the activation, as indicated by block 924. The gaming system determines an actual stop position of that reel based on the weights associated with the stop positions in the virtual map associated with the determined initiating stop position, as indicated by block 926. The gaming system stops that reel at the determined actual stop position, as indicated by block 928.

The gaming system determines whether any reels are still spinning, as indicated by diamond 930. If the gaming system determines that at least one reel is still spinning, process 900 returns to block 922. If the gaming system instead determines that all of the reels have stopped spinning, the gaming system determines whether any of the winning symbol combinations are displayed and provides any awards associated with any displayed winning symbol combinations, as indicated by block 932.

FIGS. 10A, 10B, 10C, 10D, 10E, 10F, 10G, and 10H illustrate a play of an example embodiment of the Pachisuro-style slot game of the present disclosure. In this example, the gaming system includes housing 1111 supporting first reel 1154*a*, second reel 1154*b*, and third reel 1154*c*, as described above. First reel 1154*a* includes the twenty-two stop positions and their associated virtual maps illustrated in FIGS. 5A to 5V, second reel 1154*b* includes the twenty-two stop positions and their associated virtual maps illustrated in FIGS. 6A to 6V, and third reel 1154*c* includes the twenty-two stop positions and their associated virtual maps illustrated in FIGS. 7A to 7V (as described above).

The gaming system is associated with symbol display areas 55*a*, 55*b*, 55*c*, 55*d*, 55*e*, 55*f*, 55*g*, 55*h*, and 55*i*. Each of the symbol display areas is associated with one of the reels and is configured to display the symbol associated with a stop position of that reel. More specifically, in this example, symbol display areas 55*a*, 55*d*, and 55*g* are associated with first reel 1154*a*; symbol display areas 55*b*, 55*e*, and 55*h* are associated with second reel 1154*b*; and symbol display areas 55*c*, 55*f*, and 55*i* are associated with third reel 1154*c*. In this example, as described above, the predetermined position for the purposes of determining the initiating stop position (as defined above) of first reel 1154*a* is defined by symbol display area 55*d*, the predetermined position for the purposes of determining the initiating stop position of second reel 1154*b* is defined by symbol display area 55*e*, and the predetermined position for the purposes of determining the initiating stop position of third reel 1154*c* is defined by symbol display area 55*f*. In this example, the stop positions of the reels are shown in the lower right corner of each symbol display area in FIGS. 10A to 10H for illustrative purposes to explain the determinations of the actual stop positions of the reels. It should be appreciated that the stop positions of the reels are not actually displayed to the player during the play of the Pachisuro-style slot game.

In this example, the Pachisuro-style slot game is associated with a plurality of paylines 1152*a*, 1152*b*, 1152*c*, 1152*d*, and 1152*e*. Payline 1152*a* is associated with symbol display areas 55*d*, 55*e*, and 55*f*; payline 1152*b* is associated with symbol display areas 55*a*, 55*b*, and 55*c*; payline 1152*c* is associated with symbol display areas 55*g*, 55*h*, and 55*i*; payline 1152*d* is associated with symbol display areas 55*a*, 55*e*, and 55*i*; and payline 1152*e* is associated with symbol display areas 55*g*, 55*e*, and 55*c*. It should be appreciated that the Pachisuro-style slot game may be associated with any suitable quantity of paylines that are associated with any suitable combination of the symbol display areas.

In this example, for each spinning reel, the gaming system provides an indication when the player should activate the associated stop input device such that a symbol of the desired winning symbol combination that corresponds to that reel has a best chance of being displayed along payline 1152*a* when that reel stops spinning. The gaming system does so by, for each spinning reel: (1) determining a desired one of the virtual maps associated with the stop positions of that reel that is associated with a highest probability of causing the gaming system to select the actual stop position of that reel such that the corresponding symbol is displayed along payline 1152*a*, and (2) designating the stop position associated with the desired virtual map as a desired initiating stop position of that reel. The gaming system provides the indication such that, if the player activates the associated stop input device in association with the provided indication, the gaming system determines the desired initiating stop position as the initiating stop position of that reel and, therefore, the probability of the corresponding symbol being displayed along payline 1152*a* is maximized.

In this example, payline 1152*a* is associated with symbol display areas 55*d*, 55*e*, and 55*f*, which are the symbol display areas employed to determine the initiating stop positions of the reels and the symbol display areas at which the symbols associated with the actual stop positions of the reels are displayed when the reels stop spinning. Thus, in this example, for each spinning reel, the gaming system: (1) determines a desired one of the virtual maps associated with the stop positions of that reel that is associated with a highest probability of causing the gaming system to select a stop position of that reel that is associated with the corresponding symbol of the desired winning symbol combination as the actual stop position of that reel such that the corresponding symbol is displayed along payline 1152*a*, and (2) designates the stop position associated with the desired virtual map as a desired initiating stop position of that reel. The gaming system provides the indication such that, if the player activates the associated stop input device in association with the provided indication, the gaming system determines the desired initiating stop position as the initiating stop position of that reel and, therefore, the probability of the gaming system determining a stop position associated with the corresponding symbol as the actual stop position of that reel (and of the corresponding symbol being displayed along payline 1152*a*) is maximized.

In this example, for a given spinning reel, the gaming system determines the desired virtual map by determining which virtual maps associated with the stop positions of that reel include at least one stop position associated with the corresponding symbol of the desired winning symbol combination. The gaming system determines the virtual map that is associated with the highest probability of the gaming system determining a stop position associated with the corresponding symbol as the actual stop position of that reel to be the desired virtual map. That is, the gaming system determines which of the virtual maps of a given reel will, if employed by the gaming system to determine the actual stop position of that reel, will be the most likely to cause the gaming system to determine a stop position associated with the corresponding symbol as the actual stop position of that reel, thereby causing that corresponding symbol to be displayed along payline 1152*a*. The gaming system designates that determined virtual map as the desired virtual map.

The gaming system determines the stop position associated with the desired virtual map to be a desired initiating stop position. Thus, the desired initiating stop position is the stop position associated with the virtual map of the plurality of virtual maps associated with the stop positions of that reel that, if employed by the gaming system to determine the actual stop position of that reel, is associated with the best probability of the stop position associated with the corresponding symbol being selected as the actual stop position of that reel.

After determining the desired initiating stop position for a given reel, the gaming system provides the indication such that, if the player activates the associated stop input device in association with the provided indication, the gaming system will determine the initiating stop position of that reel to be the desired initiating stop position and thus employ the desired virtual map to determine the actual stop position of that reel. In this example, the indication is an activation of a light surrounding the reel.

It should be appreciated, however, that any suitable indication or signal or combination of indications or signals may be used, such as a visual indication, an audial indication, and/or a tactile indication. For instance, the gaming system provides an indication associated with a given reel including: a flash of a green light "behind" the reel, an output of an audio clip reciting "Push Now!", and a vibration of the stop input device associated with that reel.

Figure 10A:
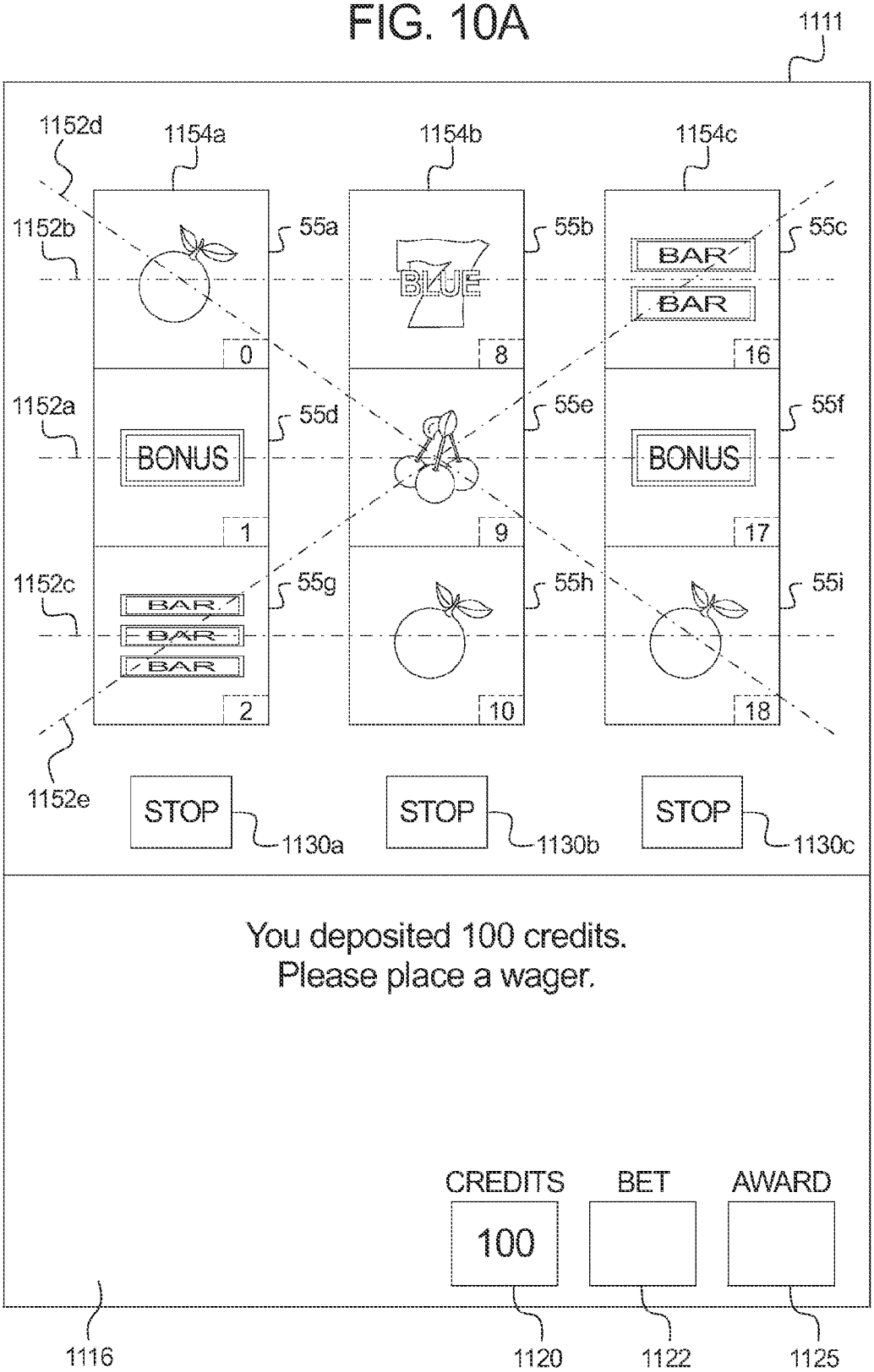
FIGS. 10A, 10B, 10C, 10D, 10E, 10F, 10G, and 10H illustrate front views of one embodiment of the gaming system of the present disclosure operating a play of one embodiment of the Pachisuro-style slot game disclosed herein.

Turning to FIG. 10A, a player funds the gaming system by depositing value. The gaming system provides the player with 100 credits, which represent the deposited value in this example. The gaming system displays the player's total credit balance of 100 credits in credit display 1120. The gaming system displays the following message: "YOU DEPOSITED 100 CREDITS. PLEASE PLACE A WAGER."

Figure 10B:
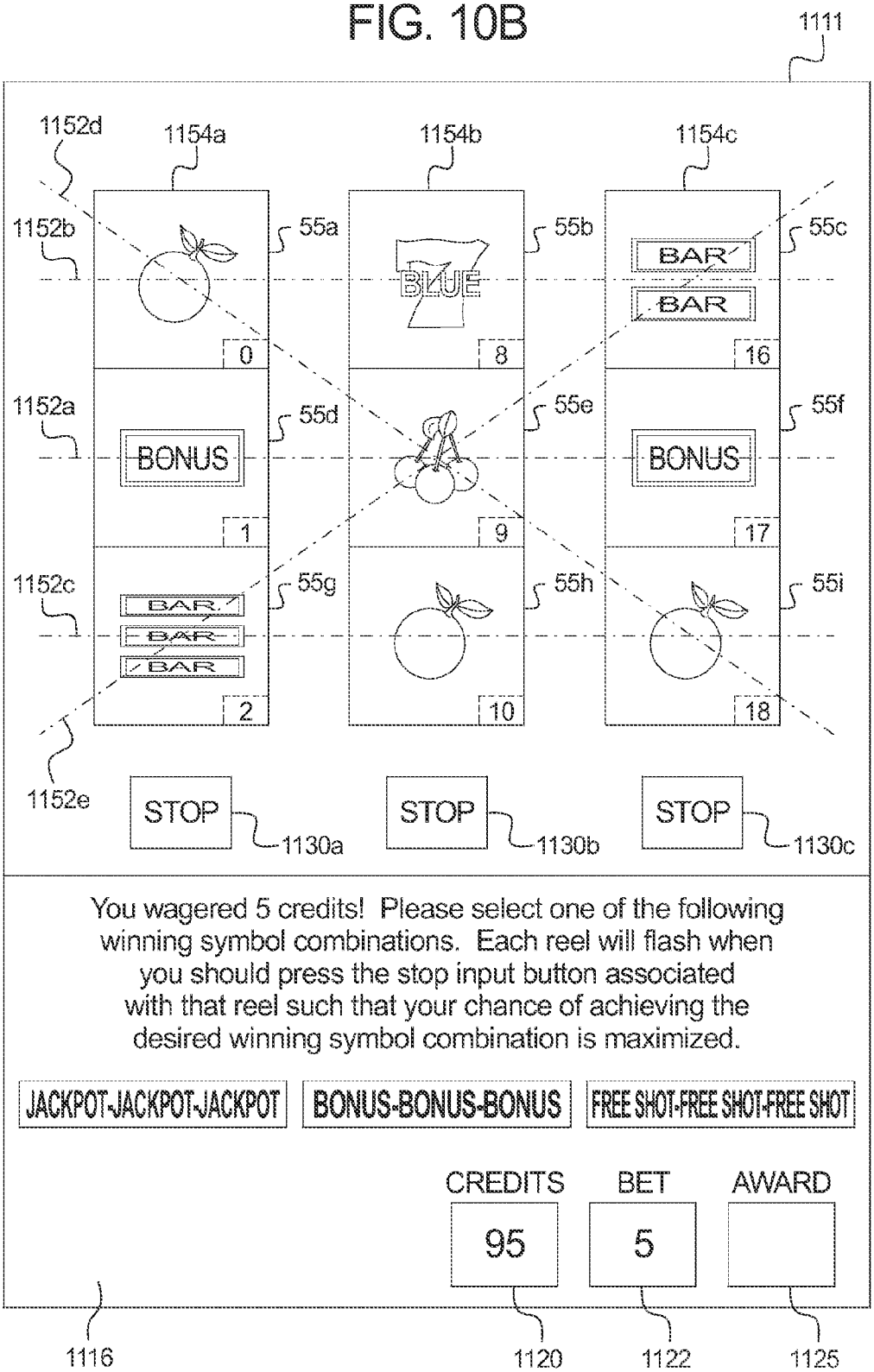

As illustrated in FIG. 10B, the player places a wager of 5 credits for a play of the Pachisuro-style slot game. The gaming system displays the player's wager of 5 credits in bet display 1122. The gaming system displays the player's total remaining credit balance of 95 credits (i.e., the player's initial credit balance of 100 credits minus the player's wager of 5 credits) in credit display 1120. After receiving the wager from the player, the gaming system displays a plurality of the winning symbol combinations and enables the player to select one of the displayed winning symbol combinations to be the desired winning symbol combination. In this example, the gaming system enables the player to select one of: the Jackpot-Jackpot-Jackpot winning symbol combination, the Bonus-Bonus-Bonus winning symbol combination, and the Free Shot-Free Shot-Free Shot winning symbol combination as the desired winning symbol combination. The gaming system displays the following message: "YOU WAGERED 5 CREDITS!PLEASE SELECT ONE OF THE FOLLOWING WINNING SYMBOL COMBINATIONS. EACH REEL WILL FLASH WHEN YOU SHOULD PRESS THE STOP INPUT BUTTON ASSOCIATED WITH THAT REEL SUCH THAT YOUR CHANCE OF ACHIEVING THE DESIRED WINNING SYMBOL COMBINATION IS MAXIMIZED."

Figure 10C:
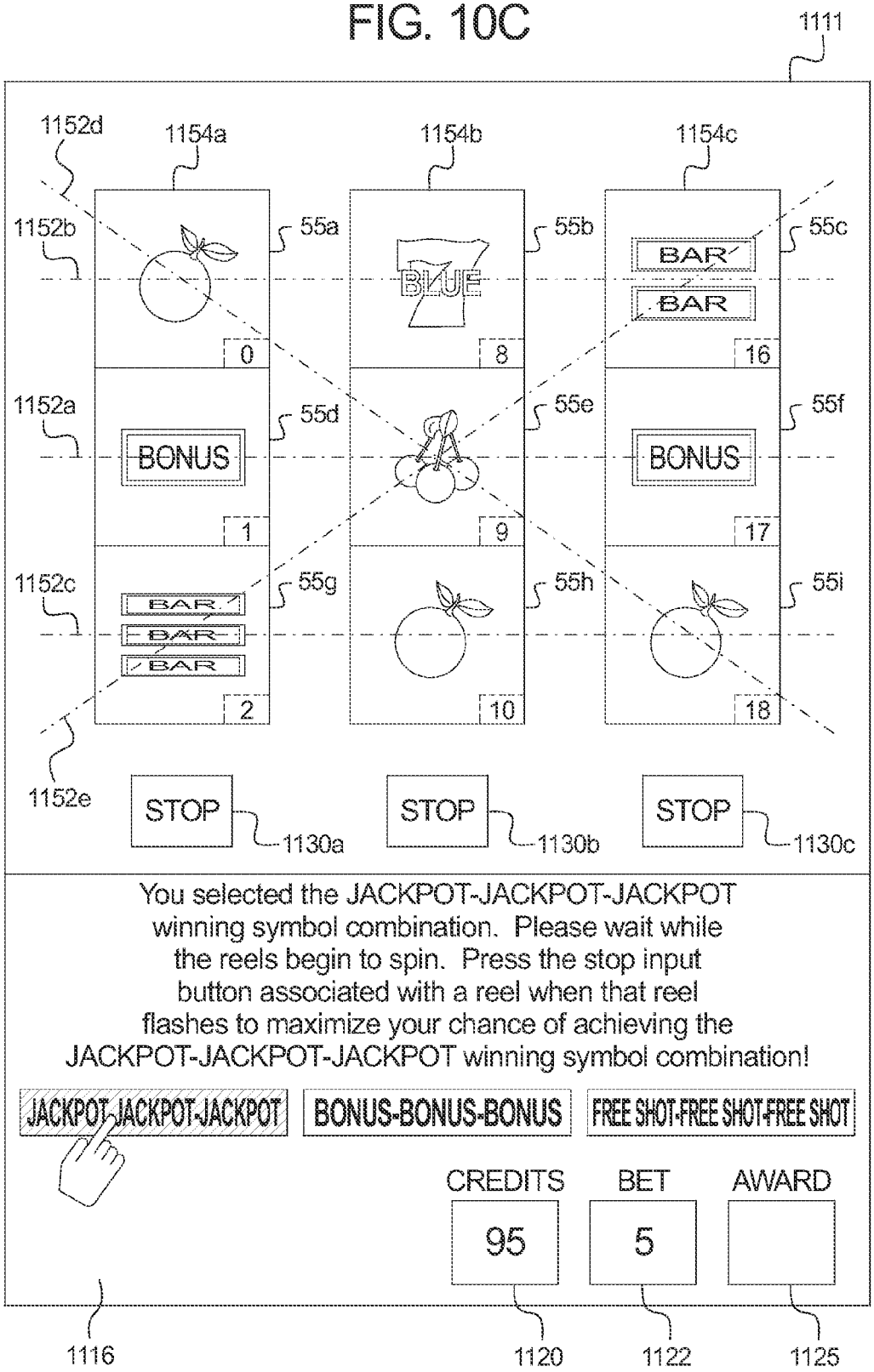

As illustrated in FIG. 10C, the gaming system receives a selection from the player of the Jackpot-Jackpot-Jackpot winning symbol combination as the desired winning symbol combination. The gaming system displays the following message: "YOU SELECTED THE JACKPOT-JACKPOT-JACKPOT WINNING SYMBOL COMBINATION. PLEASE WAIT WHILE THE REELS BEGIN TO SPIN. PRESS THE STOP INPUT BUTTON ASSOCIATED WITH A REEL WHEN THAT REEL FLASHES TO MAXIMIZE YOUR CHANCE OF ACHIEVING THE JACKPOT-JACKPOT-JACKPOT WINNING SYMBOL COMBINATION!"

In this example (and as explained above), for each reel, the gaming system provides an indication associated with that reel when the player should activate the associated stop input device such that a symbol of the desired winning symbol combination that corresponds to that reel has a best chance of being displayed along payline 1152*a* when that reel stops spinning. Thus, for each of first reel 1154*a*, second reel 1154*b*, and third reel 1154*c*, the gaming system provides an indication associated with that reel when the player should activate the associated stop input device such that the Jackpot symbol has a best chance of being displayed at symbol display areas 55*d*, 55*e*, and 55*f*, respectively, when the reels stop spinning.

For first reel 1154*a*, the gaming system determines that virtual maps 110*a*, 110*b*, 110*c*, 110*d*, 110*e*, 110*f*, 110*g*, 110*h*, 110*i*, and 110*v* each include a single stop position associated with the Jackpot symbol. Specifically, stop position 20 of virtual map 110*a* is associated with the Jackpot symbol and a weight of 19 (i.e., a 19/256 chance of being selected as the actual stop position); stop position 20 of virtual map 110*b* is associated with the Jackpot symbol and a weight of 28 (i.e., a 28/256 chance of being selected as the actual stop position); stop position 20 of virtual map 110*c* is associated with the Jackpot symbol and a weight of 46 (i.e., a 46/256 chance of being selected as the actual stop position); stop position 20 of virtual map 110*d* is associated with the Jackpot symbol and a weight of 56 (i.e., a 56/256 chance of being selected as the actual stop position); stop position 3 of virtual map 110*e* is associated with the Jackpot symbol and a weight of 28 (i.e., a 28/256 chance of being selected as the actual stop position); stop position 3 of virtual map 110*f* is associated with the Jackpot symbol and a weight of 48 (i.e., a 48/256 chance of being selected as the actual stop position); stop position 3 of virtual map 110*g* is associated with the Jackpot symbol and a weight of 59 (i.e., a 59/256 chance of being selected as the actual stop position); stop position 3 of virtual map 110*h* is associated with the Jackpot symbol and a weight of 64 (i.e., a 64/256 chance of being selected as the actual stop position); stop position 3 of virtual map 110*i* is associated with the Jackpot symbol and a weight of 47 (i.e., a 47/256 chance of being selected as the actual stop position); and stop position 20 of virtual map 110*v* is associated with the Jackpot symbol and a weight of 18 (i.e., a 18/256 chance of being selected as the actual stop position). Virtual map 110*h* is the virtual map including the stop position associated with the Jackpot symbol and the highest probability of being selected as the actual stop position (i.e., 64/256) in relation to the probabilities of being selected associated with the stop positions associated with the Jackpot symbol of virtual maps 110*a*, 110*b*, 110*c*, 110*d*, 110*e*, 110*f*, 110*g*, 110*h*, and 110*i*. Thus, the gaming system determines virtual map 110*h* to be the desired virtual map of first reel 1154*a* and stop position 7, which is associated with desired virtual map 110*h*, to be the desired initiating stop position of first reel 1154*a*.

For second reel 1154*b*, the gaming system determines that virtual maps 120*g*, 120*h*, 120*i*, 120*j*, 120*k*, 120*n*, 120*o*, 120*p*, 120*q*, and 120*r* each include a single stop position associated with the Jackpot symbol. Specifically, stop position 5 of virtual map 120*g* is associated with the Jackpot symbol and a weight of 66 (i.e., a 66/256 chance of being selected as the actual stop position); stop position 5 of virtual map 120*h* is associated with the Jackpot symbol and a weight of 11 (i.e., a 11/256 chance of being selected as the actual stop position); stop position 5 of virtual map 120*i* is associated with the Jackpot symbol and a weight of 10 (i.e., a 10/256 chance of being selected as the actual stop position); stop position 5 of virtual map 120*j* is associated with the Jackpot symbol and a weight of 6 (i.e., a 6/256 chance of being selected as the actual stop position); stop position 5 of virtual map 120*k* is associated with the Jackpot symbol and a weight of 36 (i.e., a 36/256 chance of being selected as the actual stop position); stop position 12 of virtual map 120*n* is associated with the Jackpot symbol and a weight of 44 (i.e., a 44/256 chance of being selected as the actual stop position); stop position 12 of virtual map 120*o* is associated with the Jackpot symbol and a weight of 91 (i.e., a 91/256 chance of being selected as the actual stop position); stop position 12 of virtual map 120*p* is associated with the Jackpot symbol and a weight of 89 (i.e., a 89/256 chance of being selected as the actual stop position); stop position 12 of virtual map 120*q* is associated with the Jackpot symbol and a weight of 36 (i.e., a 36/256 chance of being selected as the actual stop position); and stop position 12 of virtual map 120*r* is associated with the Jackpot symbol and a weight of 83 (i.e., a 83/256 chance of being selected as the actual stop position). Virtual map 120*o* is the virtual map including the stop position associated with the Jackpot symbol and the highest probability of being selected as the actual stop position (i.e., 91/256) in relation to the probabilities of being selected associated with the stop positions associated with the Jackpot symbol of virtual maps 120*h*, 120*i*, 120*j*, 120*k*, 120*n*, 120*p*, 120*q*, and 120*r*. Thus, the gaming system determines virtual map 120*o* to be the desired virtual map of second reel 1154*b* and stop position 14, which is associated with desired virtual map 120*o*, to be the desired initiating stop position of second reel 1154*b*.

For third reel 1154*c*, the gaming system determines that virtual maps 130*g*, 130*h*, 130*i*, 130*j*, and 130*k* each include a single stop position associated with the Jackpot symbol. Specifically, stop position 5 of virtual map 130*g* is associated with the Jackpot symbol and a weight of 19 (i.e., a 19/256 chance of being selected as the actual stop position); stop position 5 of virtual map 130*h* is associated with the Jackpot symbol and a weight of 60 (i.e., a 60/256 chance of being selected as the actual stop position); stop position 5 of virtual map 130*i* is associated with the Jackpot symbol and a weight of 26 (i.e., a 26/256 chance of being selected as the actual stop position); stop position 5 of virtual map 130*j* is associated with the Jackpot symbol and a weight of 154 (i.e., a 154/256 chance of being selected as the actual stop position); and stop position 5 of virtual map 130*k* is associated with the Jackpot symbol and a weight of 51 (i.e., a 51/256 chance of being selected as the actual stop position). Virtual map 130*j* is the virtual map including the stop position associated with the Jackpot symbol and the highest probability of being selected as the actual stop position (i.e., 154/256) in relation to the probabilities of being selected associated with the stop positions associated with the Jackpot symbol of virtual maps 130*g*, 130*h*, 130*i*, and 130*k*. Thus, the gaming system determines virtual map 130*j* to be the desired virtual map of third reel 1154*c* and stop position 9, which is associated with desired virtual map 130*j*, to be the desired initiating stop position of third reel 1154*c*.

Figure 10D:
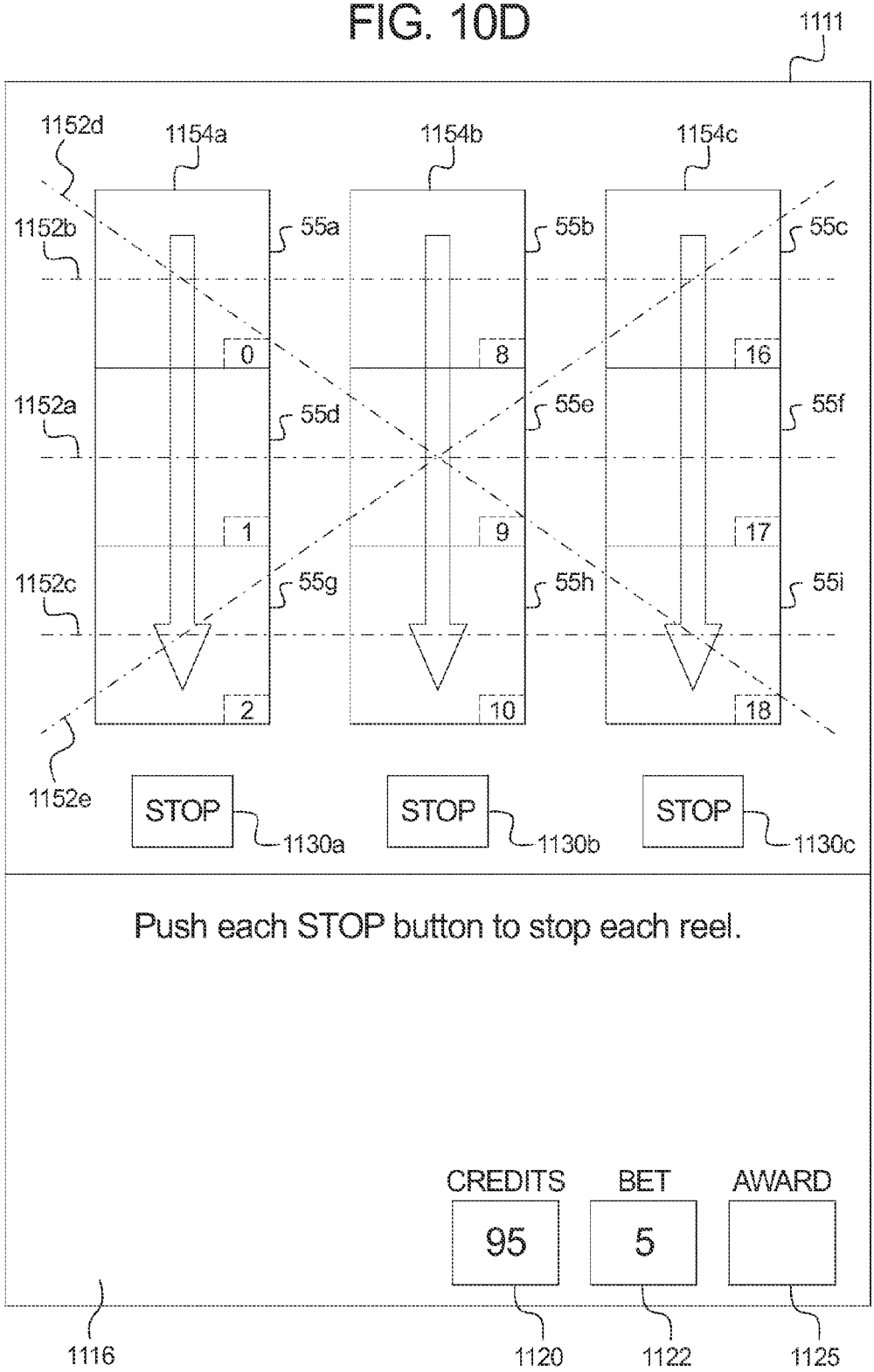

As illustrated in FIG. 10D, the gaming system begins spinning each of the reels. The gaming system enables the player to cause the gaming system to stop the reels by enabling the player to activate the stop input device associated with that reel. Specifically, the gaming system enables the player to cause the gaming system to stop first reel 1154*a* by activating first stop input device 1130*a*, to stop second reel 1154*b* by activating second stop input device 1130*b*, and to stop third reel 1154*c* by activating third stop input device 1130*c*. The gaming system displays the following message: "PUSH EACH STOP BUTTON TO STOP EACH REEL." It should be appreciated that, in this example, the gaming system does not require the player to activate the stop input devices in any particular order. In certain other embodiments, however, the gaming system requires the player to activate stop input device 1130*a* first, stop input device 1130*b* second, and stop input device 1130*c* third. It should be appreciated that the gaming system may require the player to activate the stop input devices in any suitable order or simultaneously.

Figure 10E:
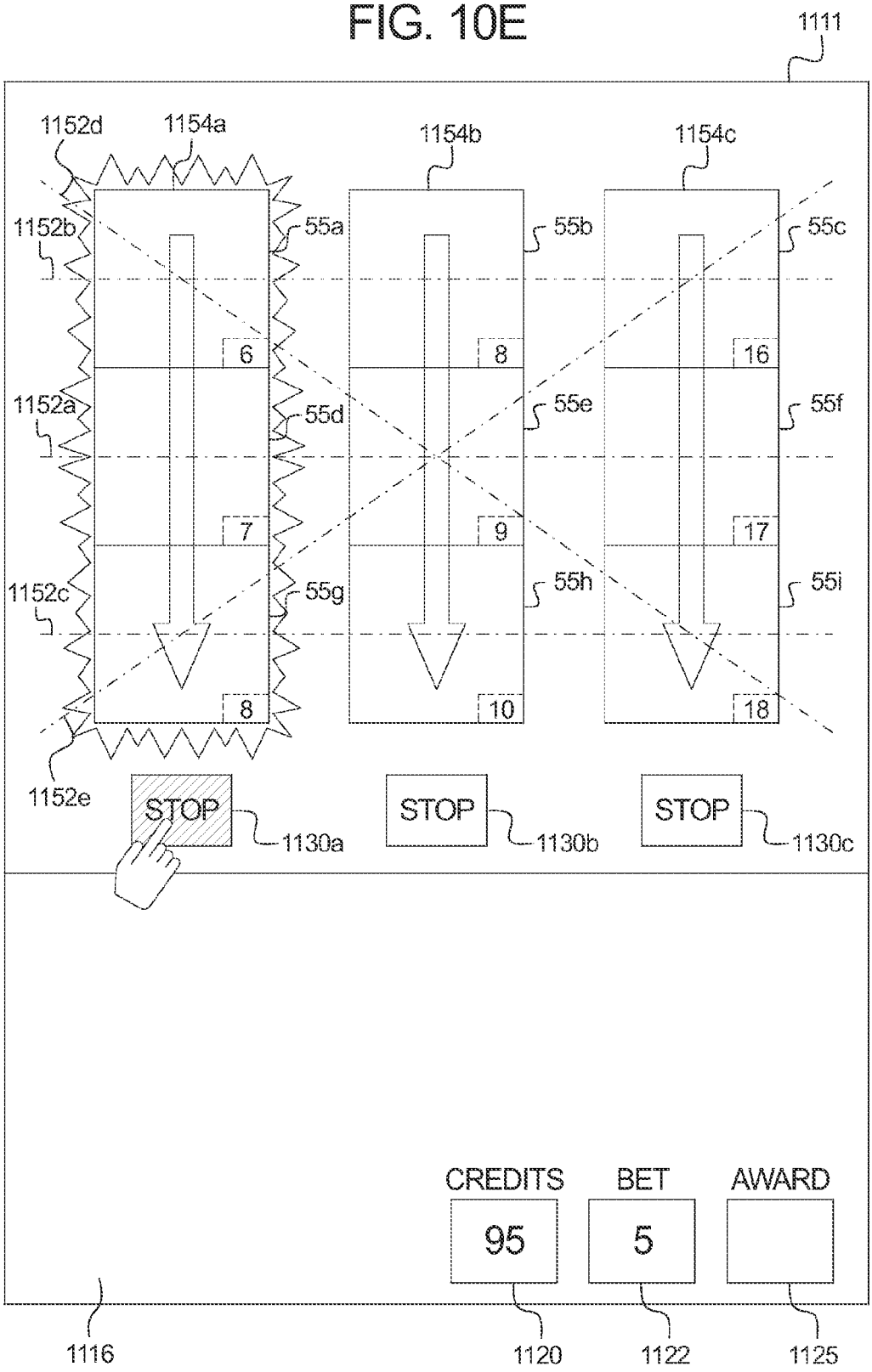

As illustrated in FIG. 10E, the gaming system displays an indication associated with first reel 1154*a* when the Blue 7 symbol associated with desired initiating stop position 7 of first reel 1154*a* is located within symbol display area 55*d*. In other words, the gaming system displays the indication such that, if the player activates stop input device 1130*a* in association with the displayed indication, the gaming system will determine desired initiating stop position 7 to be the initiating stop position of first reel 1154*a*. In this example, the gaming system receives an activation of stop input device 1130*a* when the Blue 7 symbol associated with desired initiating stop position 7 is located within symbol display area 55*d*. Thus, the gaming system determines desired initiating stop position 7 to be the initiating stop position for first reel 1154*a*, and employs desired virtual map 110*h* associated with initiating stop position 7 to determine one of stop positions 2, 3, 4, 5, and 6 of first reel 1154*a* to be the actual stop position of first reel 1154*a*.

Figure 10F:
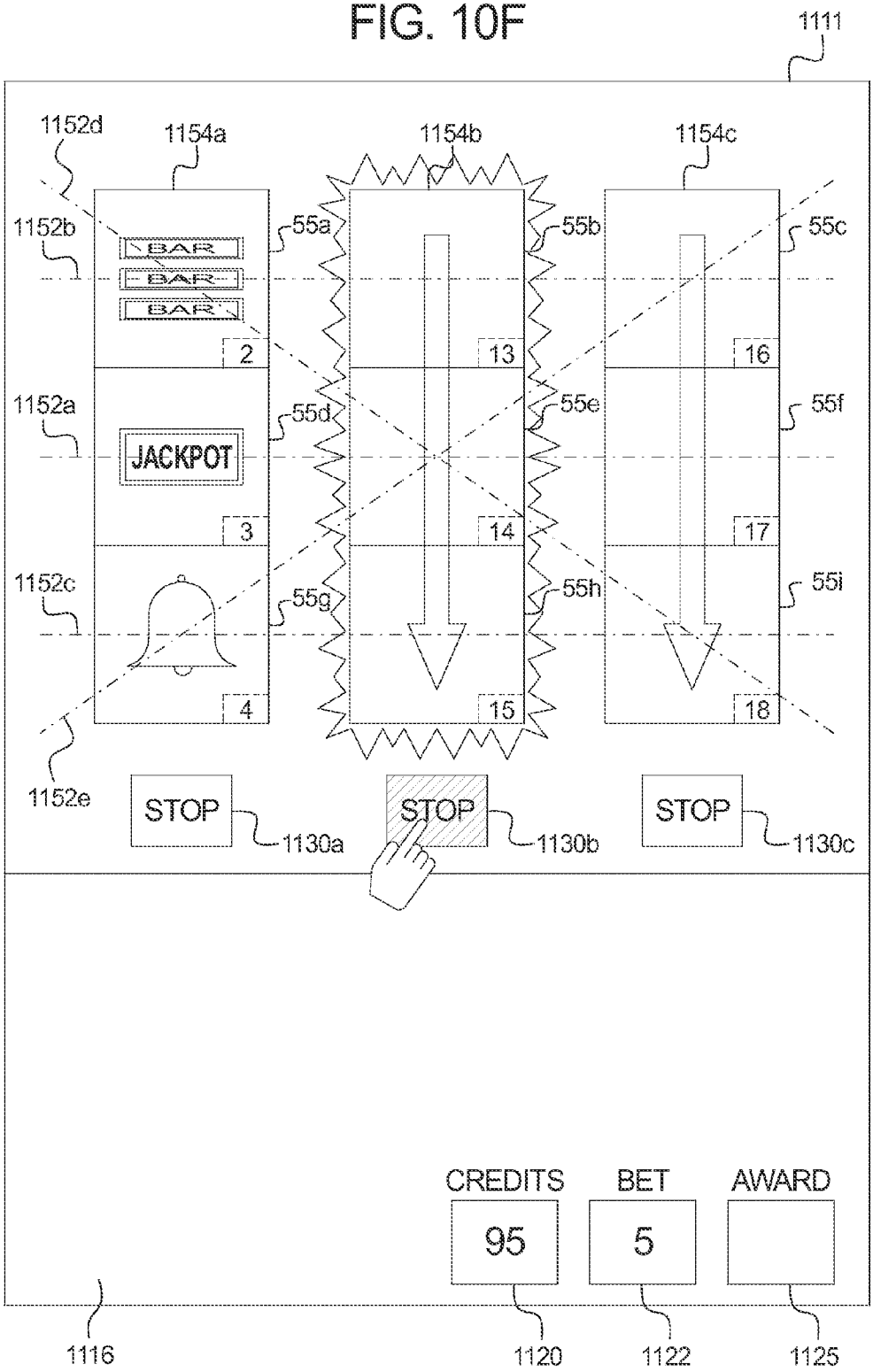

As illustrated in FIG. 10F, in this example the gaming system randomly determines stop position 3 of first reel 1154*a* to be the actual stop position of first reel 1154*a*. It should be appreciated that, in this example, there was a 25% chance (64/256) of the gaming system determining stop position 3 to be the actual stop position of first reel 1154*a*. The gaming system stops first reel 1154*a* such that the Jackpot symbol associated with actual stop position 3 is displayed at symbol display area 55*d*.

As also illustrated in FIG. 10F, the gaming system displays an indication associated with second reel 1154*b* when the Bell symbol associated with desired initiating stop position 14 of second reel 1154*b* is located within symbol display area 55*e*. In other words, the gaming system displays the indication such that, if the player activates stop input device 1130*b* in association with the displayed indication, the gaming system will determine desired initiating stop position 14 as the initiating stop position of second reel 1154*b*. In this example, the gaming system receives an activation of stop input device 1130*b* when the Bell symbol associated with desired initiating stop position 14 is located within symbol display area 55*e*. Thus, the gaming system determines desired initiating stop position 14 to be the initiating stop position of second reel 1154*b*, and employs desired virtual map 120*o* associated with initiating stop position 14 to determine one of stop positions 9, 10, 11, 12, and 13 of second reel 1154*b* to be the actual stop position of second reel 1154*b*.

Figure 10G:
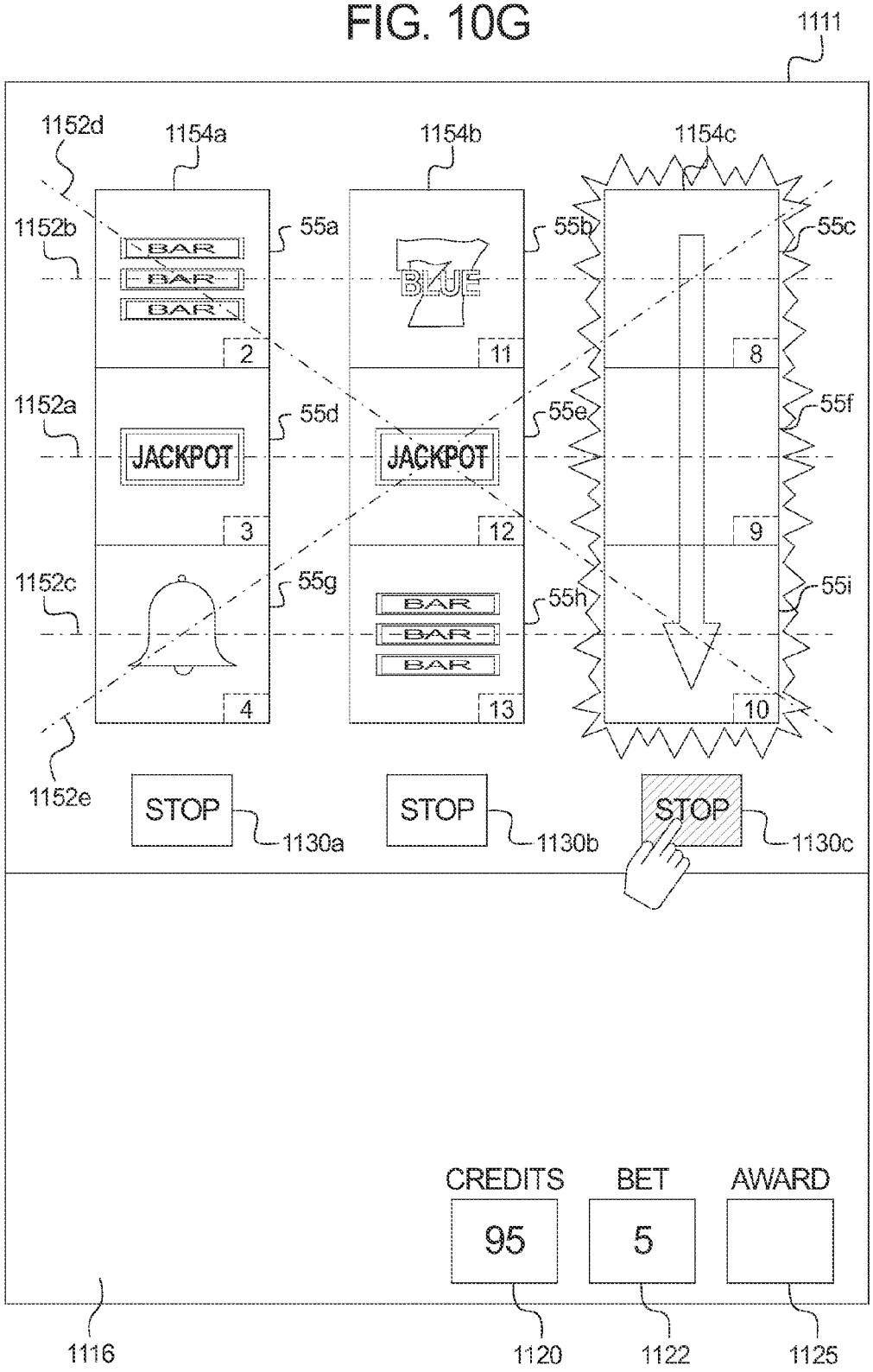

As illustrated in FIG. 10G, in this example the gaming system randomly determines stop position 12 of second reel 1154*b* to be the actual stop position of second reel 1154*b*. It should be appreciated that, in this example, there was about a 35.5% chance (91/256) of the gaming system determining stop position 12 to be the actual stop position of second reel 1154*b*. The gaming system stops second reel 1154*b* such that the Jackpot symbol associated with actual stop position 14 is displayed at symbol display area 55*e*.

As also illustrated in FIG. 10G, the gaming system displays an indication associated with third reel 1154*c* when the 2 Bar symbol associated with desired initiating stop position 9 of third reel 1154*c* is located within symbol display area 55*f*. In other words, the gaming system displays the indication such that, if the player activates stop input device 1130*c* in association with the displayed indication, the gaming system will determine desired initiating stop position 9 as the initiating stop position of third reel 1154*c*. In this example, the gaming system receives an activation of stop input device 1130*c* when the 2 Bar symbol associated with desired initiating stop position 9 is located within symbol display area 55*f*. Thus, the gaming system determines desired initiating stop position 9 to be the initiating stop position of third reel 1154*c*, and employs desired virtual map 130*j* associated with initiating stop position 9 to determine one of stop positions 4, 5, 6, 7, and 8 of third reel 1154*c* to be the actual stop position of third reel 1154*c*.

Figure 10H:
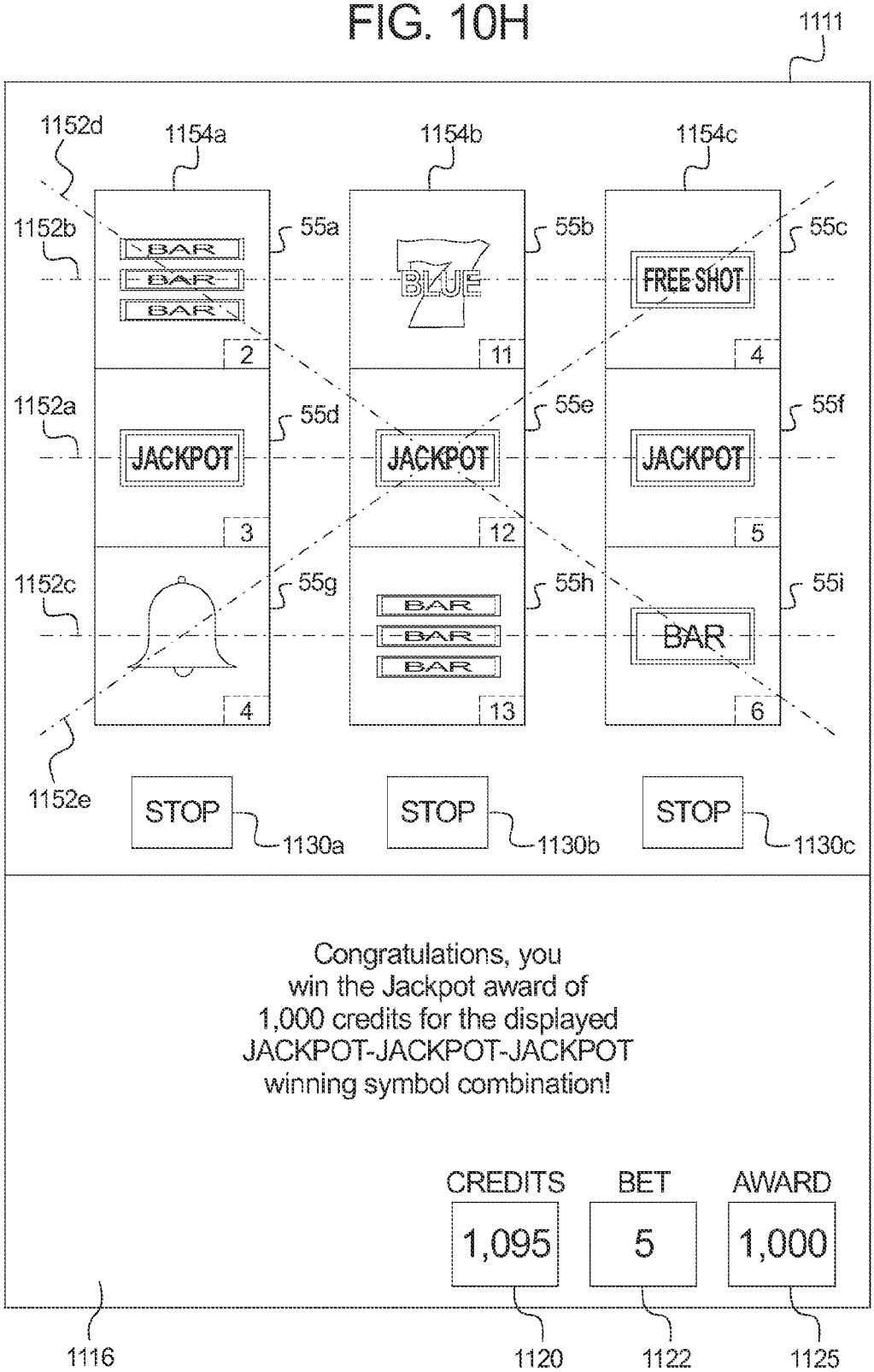

As illustrated in FIG. 10H, in this example the gaming system randomly determines stop position 5 of third reel 1154*c* to be the actual stop position of third reel 1154*c*. It should be appreciated that, in this example, there was about a 60.1% chance (154/256) of the gaming system determining stop position 5 to be the actual stop position of third reel 1154*c*. The gaming system stops third reel 1154*c* such that the Jackpot symbol associated with actual stop position 5 is displayed at symbol display area 55*f*. Since the reels have all stopped spinning, the gaming system determines whether any of the winning symbol combinations of paytable 140 (illustrated in FIG. 8) are displayed along any of the paylines. In this example, the gaming system determines that the Jackpot-Jackpot-Jackpot winning symbol combination is displayed along payline 1152*a*. The gaming system determines an award of 1,000 credits, displayed in award display 1125, and updates the player's credit balance to reflect the 1,000 credit award. The gaming system displays the following message: "CONGRATULATIONS, YOU WIN THE JACKPOT AWARD OF 1,000 CREDITS FOR THE DISPLAYED JACKPOT-JACKPOT-JACKPOT WINNING SYMBOL COMBINATION!"

In the above-described example, for each spinning reel, the gaming system provided an indication when the player should activate the associated stop input device such that a symbol of the desired winning symbol combination that corresponds to that reel has a best chance of being displayed along payline 1152*a* when that reel stops spinning. It should be appreciated that the above-described manner of determining the desired virtual maps and initiating stop positions may be modified and employed for any suitable payline or combination of paylines and for any suitable predetermined position (that is used for determining the initiating stop positions).

It should be appreciated that the gaming system may enable the player to choose the desired winning symbol combination from any suitable set of the winning symbol combinations. In various embodiments, the set of the winning symbol combinations from which the gaming system enables the player to choose the desired winning symbol combination is predetermined, randomly determined, determined by the player, and/or determined based on a wager placed by the player.

It should be appreciated that the gaming system provides the indications so long as the probability of the desired winning symbol combination being displayed is greater than zero. Put differently, the gaming system does not provide any indications associated with the spinning reel(s) if the probability of the desired winning symbol combination being displayed is zero. For example, if the desired winning symbol combination is the Jackpot-Jackpot-Jackpot winning symbol combination and at least one of the reels that has already stopped spinning does not display the Jackpot symbol, the probability of the Jackpot-Jackpot-Jackpot winning symbol combination being displayed is zero. Accordingly, the gaming system does not provide any indications associated with the remaining spinning reels because there is no chance that the desired winning symbol combination will be displayed.

In certain embodiments in which the gaming system provides a set of the winning symbol combinations, the gaming system enables the player to rank the winning symbol combinations of the set from most desired to least desired. For a play of the Pachisuro-style slot game, at any given point, the gaming system employs the winning symbol combination of the set having the highest rank and having a probability of being displayed of greater than zero as the desired winning symbol combination. In other words, the gaming system employs the most desired winning symbol combination that has a probability of being displayed of greater than zero as the desired winning symbol combination. In one embodiment, each of the different winning symbol combinations of the set is associated with a different indication.

For instance, the player ranks a set of a first, second, and third winning symbol combination in the following order: second winning symbol combination, first winning symbol combination, and third winning symbol combination. The gaming system spins the reels, and displays the indications (a green light in this example) when the player should activate the stop input devices to cause the gaming system to stop the reels such that a probability of the second winning symbol combination being displayed is maximized. If at any point during play the probability of being displayed associated with the second winning symbol combination is zero, the gaming system provides the indications (a yellow light in this example) when the player should activate the stop input devices to cause the gaming system to stop the reels such that a probability of the first winning symbol combination being displayed is maximized. If at any point during play the probability of being displayed associated with both the first and the second winning symbol combinations is zero, the gaming system displays the indications (a red light in this example) when the player should activate the stop input devices to cause the gaming system to stop the reels such that a probability of the third winning symbol combination being displayed is maximized.

In various embodiments, the gaming system employs the selected winning symbol combination as the desired winning symbol combination for: a single play of the Pachisuro-style slot game, a designated quantity of plays of the Pachisuro-style slot game (such as ten or twenty plays), a designated period of time (such as three or five minutes), or the entire duration of the gaming session.

In certain embodiments, the gaming system provides the player one or more opportunities to change the desired winning symbol combination during play of the Pachisuro-style slot game. In one such embodiment, the gaming system enables the player to change the desired winning symbol combination when the probability of the originally-chosen desired winning symbol combination being displayed is less than or equal to a designated probability. In this embodiment, the gaming system enables the player to change the desired winning symbol combination to a winning symbol combination including at least one symbol from each of the already-stopped reels. In one example, the designated probability is zero, though any suitable probability may be employed as the designated probability. In one embodiment, the gaming system requires the player to pay a fee or place an additional wager to change the desired winning symbol combination. In another embodiment, the gaming system enables the player to change the desired winning symbol combination if a designated symbol or designated symbol combination is displayed on one or more stopped reels. In a further embodiment, the gaming system enables the player to change the desired winning symbol combination at any time.

In various embodiments, the gaming system enables the player to choose desired symbols for one or more of the reels rather than (or in addition to) a desired winning symbol combination. In other embodiments, the gaming system enables the player to choose one of a plurality of different strategies for the play of the Pachisuro-style slot game, and the gaming system determines when to provide the indications such that the desired strategy has a highest probability of being carried out. In one example, the gaming system enables the player to choose from the following strategies: Highest Award, Bonus Trigger, Best Chance of Award, and Best Expected Value, though it should be appreciated that the gaming system may offer a choice of any suitable strategies.

In certain embodiments, the gaming system initially provides a default winning symbol combination for which the gaming system will provide indications. That is, the gaming system initially determines the desired winning symbol combination. In one such embodiment, the gaming system does not enable the player to change the desired winning symbol combination from the default winning symbol combination to another winning symbol combination unless and until the probability of the default winning symbol combination being displayed is zero. At that point in time, the gaming system enables the player to choose another winning symbol combination as the desired winning symbol combination. In another such embodiment, the gaming system requires the player to approve the use of the default winning symbol combination as the desired winning symbol combination prior to spinning the reels. In another such embodiment, the gaming system enables the player to change the desired winning symbol combination from the default winning symbol combination to another winning symbol combination before spinning the reels.

In one embodiment, the Pachisuro-style slot game is provided as a bonus game. In this embodiment, a play of the bonus game is triggered in association with play of any suitable base game. The gaming system enables the player to select a desired symbol, set of symbols, or winning symbol combination, and starts spinning the reels. The gaming system provides indications associated with each of the reels when the probability of the desired symbol, set of symbols, or winning symbol combination being displayed is maximized, as described above. When the gaming system receives an activation of the stop input device associated with one of the reels, the gaming system determines an initiating stop position for that reel and then determines an actual stop position of that reel based on the virtual map associated with the initiating stop position. In this example, the gaming system displays the symbol associated with the actual stop position of that reel on a tic-tac-toe board. This process continues until the board is completely filled. The gaming system determines any awards based on the filled board.

In certain embodiments, if the player does not activate any of the stop input devices within a predetermined period of time, the gaming system randomly selects an initiating stop position for each spinning reel. In certain such embodiments, each stop position of each reel is associated with a weight, and the gaming system randomly selects a stop position for each reel based on the weights associated with the stop positions. In other such embodiments, the gaming system immediately causes all of the reels to stop spinning if the player does not activate any of the stop input devices within the designated period of time. In such embodiments, the reel spin speed may be randomized such that the position of one reel relative to another varies as the reels spin. It should be appreciated that the gaming system may stop each of the reels after a different predetermined amount of time.

In another embodiment, for each of one or more of the reels, if the gaming system has not received an activation of the stop input device associated with that reel after a predetermined period of time, the gaming system uses the virtual map associated with the stop position displayed at the predetermined position at the time of the time-out to randomly select one of the stop positions to be the actual stop position of that reel. In one example, the gaming system adds a random factor to the predetermined period of time or to reel spin speed.

In various embodiments, the gaming system randomly selects a stop position for one or more, but not all, of the reels independent of any player action and the player causes the gaming system to stop one or more, but not all, of the reels based on the initiating stop position of the reel selected by the player's activation of the stop input device. For example, in an embodiment including three reels, the gaming system randomly determines respective stop positions for the first two reels, as in traditional slot machines. After the first two reels have stopped spinning, the player causes the selection of an initiating stop position and ultimate stopping of the third reel by activating the stop input device associated with the third reel. This creates an additional element of player strategy, in that the player may attempt to stop the third reel to achieve certain predetermined winning symbol combinations based on the symbols randomly determined and already displayed at the first and second reels.

In other embodiments, the gaming device enables a player to buy a skill advantage for one or more plays of the game for a designated amount of credits. In various embodiments, the skill advantage includes at least one of: (a) an automatic activation of the stop input device associated with at least one of the reels in association with a provided indication for that reel; (b) spinning one or more of the reels slower than during normal game play; and (c) spinning one or more of the reels at a constant rate. In various other embodiments, the skill advantage is triggered by a game outcome or event and is effective for a predetermined number of games or until the player wins or loses a predetermined number of games.

In various embodiments, the gaming system adjusts the speed of reel decelerations such that the reels come to a stop at the same rate after a respective stop input device is activated. For example, for a first reel, the gaming system may randomly determine a following stop position at which to stop the first reel which is three symbol positions away. For a second reel, the gaming system may randomly determine a following stop position at which to stop the second reel which is fifteen symbol positions way. In this embodiment, the gaming system stops both of the first and second reels at the same speed after the respective stop input devices are activated. Thus, the average velocity of the second reel would be higher than that of the first reel as the second reel decelerates.

In various other embodiments, the virtual maps and reel spin speeds may vary when the Pachisuro-style slot game is provided as a bonus game, providing varying skill levels. In another embodiment in which the Pachisuro-style slot game is a bonus game, the reels may spin backwards (or the opposite direction of that in the base game) in the bonus game. This would also require an additional virtual map for each stop position depending on the direction.

In another embodiment, a Pachisuro-style bonus game may challenge the player to hit a specific symbol, or activate the stop input device at the time the specific symbol is displayed at a designated symbol display area while one or more respective reels are spinning. In one such embodiment, each reel will automatically stop a designated number (e.g., two) of stop positions after the stop input device is activated. In certain embodiments of this bonus game, multiple spins of one or more reels are provided to the player and the reel spin speed increases sequentially with each subsequent spin.

In another embodiment in which the Pachisuro-style slot game is provided as a bonus game, the gaming system improves the players odds of receiving a desired award by using the same paytable for consecutive stop positions. In such embodiments, the virtual maps for one or more consecutive stop positions include the same range of stop positions and respective weights, such that the player has a larger period of time (or range of stop positions) during which to stop the reels.

In another embodiment in which the Pachisuro-style slot game is a bonus game, the gaming system enables the player to stop each of the plurality of reels of the game at the same time by activating a single stop input device. In this embodiment, when the player selects the stop input device, the reels will stop such that an aligned symbol combination is displayed at the reels.

In various embodiments, the Pachisuro-style slot game includes different skill levels. In certain such embodiments, a player may receive higher awards for higher skill levels. The player may select which skill level they want to play. In this case, the player would know that they may receive smaller payouts for the same winning combinations for playing an easy version compared to playing a higher skill level version. In one embodiment, the reels spin faster in higher skill levels. Alternatively, the cost to play may be different to play a higher skill level version.

In other embodiments, digital glass or another suitable display may display a persistence game including storyboarding. In such embodiments, various game events or bonuses in the Pachisuro-style slot game enable the player to advance in the persistence game. For example, certain symbols associated with stop positions on the reels could cause certain events to happen in the persistence game. In one simple example, the persistence game has a travel theme in which a player travels to different destinations. A designated symbol is a plane ticket symbol, or other suitable symbol, symbolizing an advance to another destination or level in the persistence game. If this symbol is displayed when the reels come to a stop, the player advances as appropriate in the persistence game. It should be appreciated that such a persistence game may have any game theme in various other embodiments.

In another embodiment, the gaming device plays music while the player is playing the Pachisuro-style slot game. In one such embodiment, the music is synchronized with the spinning of the reels to help the player develop a "rhythm" which aids in stopping the reels at desired times. For example, in one embodiment, the reels spin at 80 revolutions per minute and the music being played includes 80 beats per minute, or a multiple thereof. Additionally, in a higher skill level version, the beats per minute may be slightly different than the revolutions per minute in an attempt to challenge the player's timing. It should be appreciated that in various other embodiments, the reels may spin at any suitable speed.

It should be appreciated that in various other embodiments, the Pachisuro-style slot game may include independent reels. Specifically, in such an embodiment, independent reels associated with each respective symbol display area spin independently, in any direction and start and stop at different times as desired by the implementer. It should be appreciated that in such an embodiment, each of a plurality of stop input devices could be associated with a plurality of independent reels (e.g., three) stacked vertically. In one such embodiment, a player stops each of the independent reels in a column by activating the stop input device associated with the column. In other such embodiments, different stop input devices are associated with each respective independent reel, or any suitable number of the independent reels.

It should be appreciated that in various other embodiments, the Pachisuro game is offered in a multi-player configuration. In one such embodiment, different players activate the respective stop input devices for each of a plurality of different reels. In such embodiments, players may share an award in any suitable manner or an award may only be provided to a designated player. It should also be appreciated that in various such embodiments, the multi-player configuration may be provided as a bonus game incorporating a central display, wherein players qualify for the bonus play based on suitable base game or wager-based criteria.

It should be appreciated that in various embodiments, the gaming system stores an additional virtual map for each entire reel including each of the stop positions of the respective reel and a weight associated with each respective stop position in the virtual map for the entire reel. In one such embodiment, if the player has not activated the stop input device associated with the mechanical reel after a predetermined amount of time, the gaming system determines which of the stop positions the mechanical reel will stop at using the virtual map for the entire reel, based on the weights in the virtual map for the entire reel and a randomly determined number.

It should be appreciated that each of the foregoing examples are for illustrative purposes and that any of the features of any of the examples or other disclosure herein may be combined in any manner.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 11A:
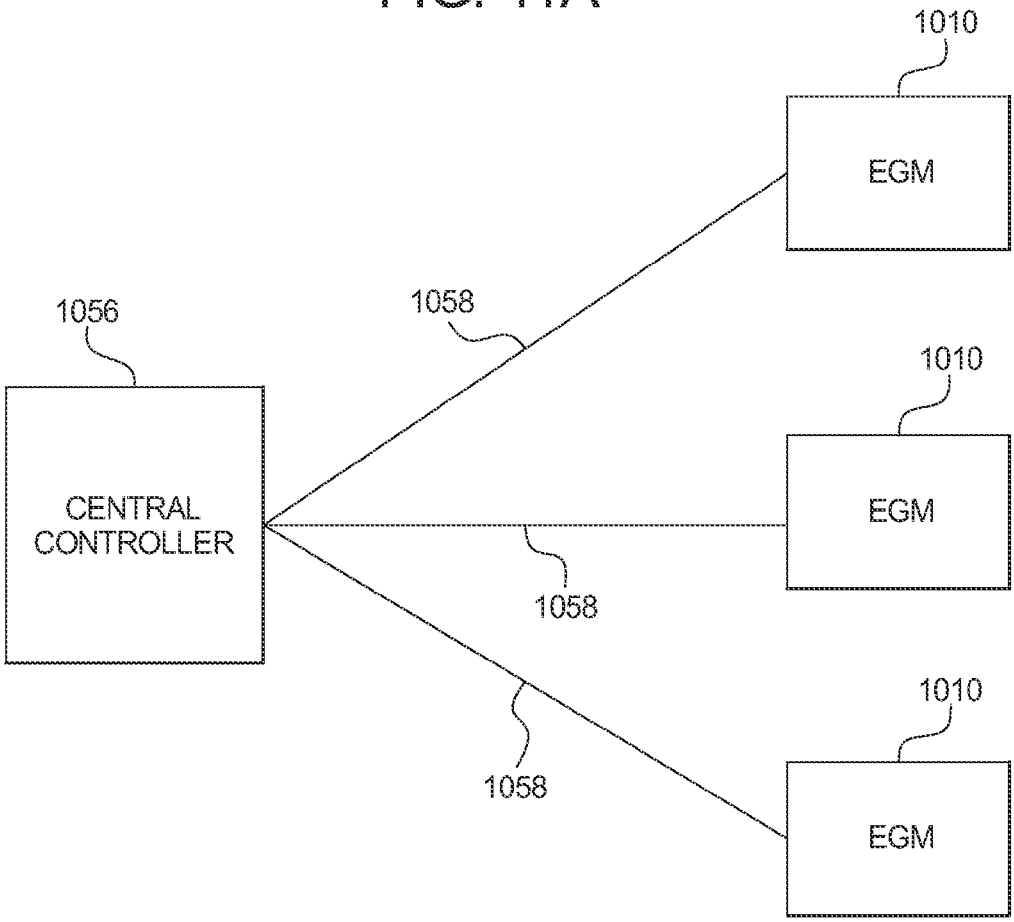
FIG. 11A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 11A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 11B:
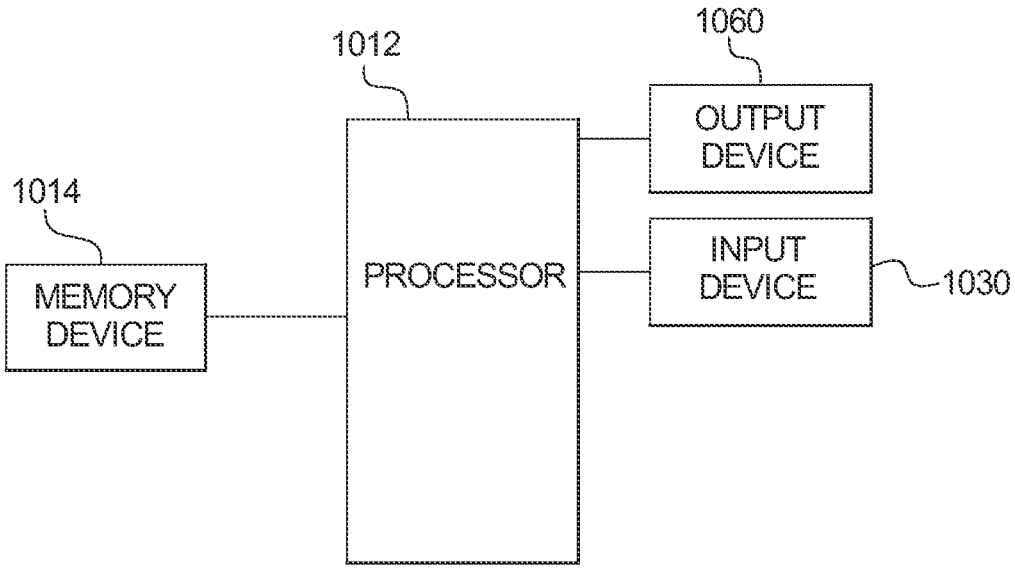
FIG. 11B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 11B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 11B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

In various embodiments, the EGM includes one or more input devices. The input devices may include any suitable device that enables an input signal to be produced and received by the at least one processor of the EGM. The example EGM illustrated in FIG. 11B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 1A and 1B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 1A and 1B each include a game play activation device in the form of a game play initiation button 1132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 1A and 1B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 1A and 1B each include a card reader 1138. The card reader is configured to read a player identification card inserted into the card reader.

In various embodiments, the EGM includes one or more output devices. The example EGM illustrated in FIG. 11B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 1A includes a central display device 1116, a player tracking display 1140, a credit display 1120, and a bet display 1122. The example EGM illustrated in FIG. 1B includes a central display device 1116, an upper display device 1118, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 1A and 1B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 1A and 1B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 1A and 1B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 1A and 1B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games. In certain embodiments, the primary game and/or the secondary game is a Pachisuro-type game as described above.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain embodiments, one or more of the reels are independent reels or unisymbol reels. In such embodiments, each independent reel generates and displays one symbol.

In one embodiment, such as that shown in FIG. 1A, the display device includes a first reel 1154*a*, a second reel 1154*b* and a third reel 1154*c*. In this embodiment, the reels are mechanical reels. In this embodiment, each of reels 1154*a*, 1154*b* and 1154*c* includes a plurality of stop positions. In one such embodiment, each reel is associated with a step motor (not shown) controlled by processor 1112. The step motors are driven by short digital pulses of electricity controlled by gaming system and, specifically, the processor. The step motors are designed to rotate a constant angle per drive pulse. The gaming system is thus enabled to move a reel a designated number of positions because a game designer is enabled to program a designated number of drive pulses to correspond to a stop position. Thus, for example, the gaming system may cause first reel 1154*a* to move two stop positions by sending a number of drive pulses corresponding to two stop positions to the step motor associated with first reel 1154*a*.

Step motors enable the gaming system to control how many stop positions a reel spins from a reference position. However, in various other embodiments in which the reels are mechanical reels, the gaming system tracks the exact stop position of each reel as it is spinning and is enabled to control what specific stop position a reel stops at, not just how many stop positions from a reference position the reel stops. In such embodiments, if the gaming system is to stop a reel at a specific position, the gaming system must have data indicating the current stop position of the reel to determine how many further stop positions to cause the step motor to move the reel.

In one embodiment, the gaming system receives inputs from photoelectric diodes (not shown), which generate a current when exposed to light, to track the movement of the reel and its current stop position. In this embodiment, each of first reel 1154*a*, second reel 1154*b* and third reel 1154*c* defines a series of holes around its side, wherein each hole is associated with a stop position of its respective reel. The photoelectric diode of each reel is positioned on the side of the reel such that as the reel turns it receives light from a light source configured to shine through the holes on the side of the reel each time the reel moves a stop position. In this embodiment, when the reel is installed, a designated stop position is calibrated as a first stop position. Since a mechanical reel has a fixed number of stop positions in a designated order, the gaming system is enabled to track exactly what stop positions are displayed at various display areas because each time the photodiode receives light, it sends an electric signal to the processor indicating the reel has moved a stop position.

In another embodiment, the gaming system keeps track of what stop positions are displayed at various display areas associated with a respective reel by counting drive pulses of the step motor. In this embodiment, drive pulses sent to a respective step motor (each drive pulse corresponding to a stop position) by processor 1112 are cumulatively counted by processor 1112. In this embodiment, processor 1112 resets the count to zero every one rotation of the respective reel. In this embodiment, processor 1112 resets the drive pulse count upon receipt of a signal indicating a complete rotation of the reel. In various embodiments, a complete rotation of the reel could be indicated by a photo diode arrangement as discussed above, or another suitable electromechanical device know in the art.

It should be appreciated that although the above example describes an embodiment in which first reel 1154*a*, second reel 1154*b* and third reel 1154*c* are mechanical reels, in various other embodiments the reels are video reels displayed on one of display devices 1116 and 1118. In one such embodiment, memory device 1114 stores a plurality of virtual reel strips and the gaming system simulates the spinning of a mechanical reel, enabling the player to see the symbols of the reel strip associated with the virtual reel as the reel spins. For example, the EGM shown in FIG. 1B includes a first reel 1157*a*, a second reel 1157*b*, and a third reel 1157*c* that are video reels.

In another embodiment, the gaming system includes a multi-layer display, or multiple display devices arranged in a common line of sight. The common line of sight passes through a portion of an exterior display device and to a portion of an interior display device. In some cases, an intermediate display device or light filter is also included between the exterior display device and the interior display device and the common line of sight passes through a portion of the intermediate display device as well. A touch screen (described above) may also be added outside the exterior display device to facilitate player input and gaming machine interaction. The common line of sight arrangement permits a player to view video output on all the display devices simultaneously or without substantially changing their position or line of sight.

In one embodiment, the interior display device includes a digital display device that includes a curved surface. The curved surface may be used to show virtual video reels that resemble mechanical reels. The digital display device, however, permits the number of reels and the symbols on each reel to be changed, as desired.

The multiple display devices may be used in many ways. In one embodiment, a single game is output using all the display devices, which cooperate to form a single coordinated visual presentation. Different depths provided by the multiple display devices improve presentation of three-dimensional graphics.

In another embodiment, the multiple display devices output video for different games or purposes. For example, the interior display device may output a game, while the intermediate display device outputs a bonus game or pay table associated with the interior display, while the exterior and foremost display device provides a progressive game or is reserved for player interaction and video output with the touch screen.

In one embodiment, the exterior display device has a screen that has the capacity to be completely or partially translucent or transparent at controlled times and/or at controlled portions and locations on the screen. An intermediate display device can have the same see-through capacity. When one of the proximate display screens is transparent or translucent, a player can see images displayed on one of the distal display devices.

In certain embodiments, the gaming system includes one or more paylines associated with the reels. The example EGM shown in FIG. 1B includes a plurality of reels 1157*a*, 1157*b*, and 1157*c* and associated paylines 1152*a*, 1152*b*, 1152*c*, 1152*d*, and 1152*e*. In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being eamed during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system including:

at least one display device including a plurality of reels, wherein each reel is associated with a plurality of stop positions and each stop position is associated with one of a plurality of different symbols;

a plurality of input devices including a separate stop input device for each reel;

at least one processor; and at least one memory device storing:

(a) for each reel, for each stop position associated with said reel, a virtual map including a plurality of the stop positions associated with said reel, each of the plurality of the stop positions associated with one of a plurality of different weights;

(b) a paytable including a plurality of different winning symbol combinations, each of the winning symbol combinations being associated with one of a plurality of different awards; and (c) a plurality of instructions which, when executed by the at least one processor, cause the at least one processor to operate with the at least one input device and the at least one display device, for a play of a game, to:

(i) receive, from a player, an input associated with a desired one of the winning symbol combinations;

(ii) spin each reel;

(iii) for at least one reel, while said reel is spinning:

(A) enable a player to activate the stop input device associated with said reel to cause an initiating stop position to be determined;

(B) if a probability of the desired winning symbol combination being displayed is greater than zero, provide an indication when the player should activate the stop input device associated with said reel such that a probability of the desired winning symbol combination being displayed is maximized;

(C) if the probability of the desired winning symbol combination being displayed is zero, do not provide said indication;

(D) receive an activation of the stop input device associated with said reel and determine the initiating stop position based on said activation;

(E) determine an actual stop position of said reel based on the weights associated with the stop positions in the virtual map associated with said determined initiating stop position; and (F) stop said reel at said determined actual stop position;

(iv) after the reels stop spinning, determine if any of the winning symbol combinations are displayed; and (v) provide the awards associated with any displayed winning symbol combinations.

2. The gaming system of claim 1, wherein the plurality of instructions, when executed by the at least one processor, cause the at least one processor to, if the probability of the desired winning symbol combination being displayed is zero after each of at least one, but fewer than all, of the reels stops spinning:

(a) receive, from the player, an input associated with a second desired one of the winning symbol combinations; and (b) for at least one of the reels, while said reel is spinning:

(i) enable the player to activate the stop input device associated with said reel to cause an initiating stop position to be determined;

(ii) provide an indication when the player should activate the stop input device associated with said reel such that a probability of the second desired winning symbol combination being displayed is maximized;

(iii) receive an activation of the stop input device associated with said reel and determine the initiating stop position based on said activation;

(iv) determine an actual stop position of said reel based on the weights associated with the stop positions in the virtual map associated with said determined initiating stop position; and (v) stop said reel at said determined actual stop position.

3. The gaming system of claim 2, wherein the second desired winning symbol combination includes at least one of the symbols displayed by each stopped reel.

4. The gaming system of claim 1, wherein the plurality of instructions, when executed by the at least one processor, cause the at least one processor to, for at least one reel, while said reel is spinning, provide the indication when the player should activate the stop input device associated with said reel such that the probability of the desired winning symbol combination being displayed is maximized by, for one of the symbols of the desired winning symbol combination that is associated with said reel:

(a) determining a desired one of the virtual maps associated with the stop positions of said reel that includes a stop position that is: (i) associated with said symbol, and (ii) associated with a highest probability of being selected as the actual stop position relative to probabilities of being selected of the stop positions of the other virtual maps associated with the stop positions of said reel that are also associated with said symbol;

(b) designating the stop position associated with the desired virtual map as a desired initiating stop position; and (c) providing the indication when the player should activate the stop input device associated with said reel such that said desired initiating stop position is the initiating stop position.

5. The gaming system of claim 1, wherein the plurality of instructions, when executed by the at least one processor, cause the at least one processor to, for at least one reel, determine the initiating stop position of said reel based on a location of one or more of the symbols on said reel in relation to a designated one of a plurality of symbol display areas upon receipt of the activation of the stop input device associated with said reel.

6. The gaming system of claim 1, wherein the plurality of instructions, when executed by the at least one processor, cause the at least one processor to provide (c) for each and every reel.

7. The gaming system of claim 1, wherein the reels are mechanical reels.

8. The gaming system of claim 1, wherein the reels are video reels.

9. A method of operating a gaming system including a plurality of reels, each reel being associated with a plurality of stop positions and each stop position being associated with one of a plurality of different symbols, said method comprising:

causing at least one processor to execute a plurality of instructions stored in at least one memory device to operate with at least one display device and at least one input device, for a play of a game, to:

(a) receive, from a player, an input associated with a desired one of a plurality of different winning symbol combinations;

(b) spin each reel, wherein, for each reel, each stop position associated with said reel is associated with a virtual map including a plurality of the stop positions associated with said reel, each of the plurality of the stop positions associated with one of a plurality of different weights;

(c) for at least one reel, while said reel is spinning:

(i) enable a player to activate a stop input device associated with said reel to cause an initiating stop position to be determined;

(ii) if a probability of the desired winning symbol combination being displayed is greater than zero, provide an indication when the player should activate the stop input device associated with said reel such that a probability of the desired winning symbol combination being displayed is maximized;

(iii) if the probability of the desired winning symbol combination being displayed is zero, (iv) receive an activation of the stop input device associated with said reel and determine the initiating stop position based on said activation;

(v) determine an actual stop position of said reel based on the weights associated with the stop positions in the virtual map associated with said determined initiating stop position; and (vi) stop said reel at said determined actual stop position; and (d) after the reels stop spinning, determine if any of the winning symbol combinations are displayed; and providing the awards associated with any displayed winning symbol combinations.

10. The method of claim 9, which includes causing the at least one processor to execute the plurality of instructions to operate with the at least one input device and the at least one display device to, if the probability of the desired winning symbol combination being displayed is zero after each of at least one, but fewer than all, of the reels stops spinning:

(a) receive, from the player, an input associated with a second desired one of the winning symbol combinations; and (b) for at least one of the reels, while said reel is spinning:

(i) enable the player to activate the stop input device associated with said reel to cause an initiating stop position to be determined;

(ii) provide an indication when the player should activate the stop input device associated with said reel such that a probability of the second desired winning symbol combination being displayed is maximized;

(iii) receive an activation of the stop input device associated with said reel and determine the initiating stop position based on said activation;

(iv) determine an actual stop position of said reel based on the weights associated with the stop positions in the virtual map associated with said determined initiating stop position; and (v) stop said reel at said determined actual stop position.

11. The method of claim 10, wherein the second desired winning symbol combination includes at least one of the symbols displayed by each stopped reel.

12. The method of claim 9, which includes causing the at least one processor to execute the plurality of instructions to operate with the at least one display device to, for at least one reel, while said reel is spinning, provide the indication when the player should activate the stop input device associated with said reel such that the probability of the desired winning symbol combination being displayed is maximized by, for one of the symbols of the desired winning symbol combination that is associated with said reel:

(a) determining a desired one of the virtual maps associated with the stop positions of said reel that includes a stop position that is: (i) associated with said symbol, and (ii) associated with a highest probability of being selected as the actual stop position relative to probabilities of being selected of the stop positions of the other virtual maps associated with the stop positions of said reel that are also associated with said symbol;

(b) designating the stop position associated with the desired virtual map as a desired initiating stop position; and (c) providing the indication when the player should activate the stop input device associated with said reel such that said desired initiating stop position is the initiating stop position.

13. The method of claim 9, which includes causing the at least one processor to execute the plurality of instructions to, for at least one reel, determine the initiating stop position of said reel based on a location of one or more of the symbols on said reel in relation to a designated one of a plurality of symbol display areas upon receipt of the activation of the stop input device associated with said reel.

14. The method of claim 9, which includes providing (c) for each and every reel.

15. The method of claim 9, wherein the reels are mechanical reels.

16. The method of claim 9, wherein the reels are video reels.

17. The method of claim 9, which is provided through a data network.

18. The method of claim 17, wherein the data network is an internet.

* * * * *